US010752326B1

(12) United States Patent
Streng

(10) Patent No.: US 10,752,326 B1
(45) Date of Patent: Aug. 25, 2020

(54) WATERCRAFT SELF-RESCUE REENTRY DEVICE

(71) Applicant: Michael Howard Streng, Plain City, OH (US)

(72) Inventor: Michael Howard Streng, Plain City, OH (US)

( * ) Notice: Subject to any disclaimer, the term of this patent is extended or adjusted under 35 U.S.C. 154(b) by 0 days.

(21) Appl. No.: 16/402,102

(22) Filed: May 2, 2019

Related U.S. Application Data

(60) Provisional application No. 62/667,507, filed on May 5, 2018.

(51) Int. Cl.
*B63C 9/28* (2006.01)
*B63B 34/20* (2020.01)
*B63B 34/26* (2020.01)

(52) U.S. Cl.
CPC ..... *B63C 9/28* (2013.01); *B63B 34/20* (2020.02); *B63B 34/26* (2020.02)

(58) Field of Classification Search
CPC ..... B63B 35/71; B63B 2035/715; B63C 9/28
See application file for complete search history.

(56) References Cited

U.S. PATENT DOCUMENTS 6,769,378 B1 * 8/2004 Dang ..... B63B 27/146 114/347
2005/0076821 A1 * 4/2005 Baker ..... B63B 27/146 114/362
2012/0090522 A1 * 4/2012 Beaty ..... B63B 21/26 114/230.13

* cited by examiner

*Primary Examiner* — Stephen P Avila
(74) *Attorney, Agent, or Firm* — The Law Office of Patrick F. O'Reilly, III, LLC

(57) ABSTRACT

A watercraft self-rescue reentry device configured to facilitate a reentry of a user into a watercraft is disclosed herein. In one or more embodiments, the watercraft self-rescue reentry device includes at least one pole member, the at least one pole member including at least one attachment device for attaching the at least one pole member to the watercraft; a foot step coupled to the at least one pole member, the foot step configured to accommodate a foot of a user stepping thereon while the user is attempting to reenter the watercraft from water surrounding the watercraft; and a water anchor device coupled to the at least one pole member, the water anchor device configured to resist a moment applied to the at least one pole member by the user stepping on the foot step by means of the water anchor device being at least partially immersed in the water.

18 Claims, 16 Drawing Sheets

Section View A-A

WATERCRAFT SELF-RESCUE REENTRY DEVICE

CROSS-REFERENCE TO RELATED APPLICATIONS

This patent application claims priority to, and incorporates by reference in its entirety, U.S. Provisional Patent Application No. 62/667,507, entitled "Watercraft Self-Rescue Reentry Device", filed on May 5, 2018.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a watercraft self-rescue reentry device. More particularly, the invention relates to a watercraft self-rescue reentry device configured to facilitate a reentry of a user into a watercraft, such as a kayak, canoe, or any other narrow beam watercraft.

2. Background

In small recreational watercrafts, such as kayaks and canoes, capsizing poses a significant danger to the users thereof. After all, in some unfortunate cases, capsizing can lead to the death of the users of these watercrafts by drowning. As such, being able to reenter the watercraft when capsized is an imperative safety skill. Currently, there are very few options to aid in reentry for self-rescue.

Therefore, what is needed is a watercraft self-rescue reentry device that is configured to make reentry easy for people of all ages and experience levels, thus bringing safety to the users of small recreational watercrafts. Moreover, a watercraft self-rescue reentry device is needed that reduces the capsized time of small recreational watercrafts so as to reduce the risk of drowning for the users thereof. Furthermore, there is a need for a watercraft self-rescue reentry device that adds completely new levels of safety to popular paddlesports, such as kayaking and canoeing.

BRIEF SUMMARY OF EMBODIMENTS OF THE INVENTION

Accordingly, the present invention is directed to a watercraft self-rescue reentry device that substantially obviates one or more problems resulting from the limitations and deficiencies of the related art.

In accordance with one or more embodiments of the present invention, there is provided a watercraft self-rescue reentry device configured to facilitate a reentry of a user into a watercraft. The watercraft self-rescue reentry device includes at least one pole member, the at least one pole member including at least one attachment device for attaching the at least one pole member to the watercraft; a foot step coupled to the at least one pole member, the foot step configured to accommodate a foot of a user stepping thereon while the user is attempting to reenter the watercraft from water surrounding the watercraft; and a water anchor device coupled to the at least one pole member, the water anchor device configured to resist a moment applied to the at least one pole member by the user stepping on the foot step, the water anchor device configured to resist the moment applied to the at least one pole member by means of being at least partially immersed in the water.

In a further embodiment of the present invention, the at least one pole member comprises a first pole member and a second pole member, the first pole member configured to be attached to the watercraft by the at least one attachment device, and the second pole member configured to be telescopically received within the first pole member, the second pole member configured to be slidingly displaced relative to the first pole member between a stowed position where the second pole member is disposed inside the first pole member and an extended position where the second pole member extends outwardly from an end of the first pole member, the second pole member being coupled to one of the foot step and the water anchor device.

In yet a further embodiment, the at least one pole member comprises a first pole member, a second pole member, and a third pole member, the first pole member configured to be attached to the watercraft by the at least one attachment device, and the second and third pole members each configured to be telescopically received within the first pole member, the second and third pole members configured to be slidingly displaced relative to the first pole member between stowed positions where the second and third pole members are disposed inside the first pole member and extended positions where the second and third pole members extend outwardly from respective ends of the first pole member, the second pole member being coupled to the foot step and the third pole member being coupled to the water anchor device.

In still a further embodiment, the foot step is connected to the second pole member by a first cord member, and the water anchor device is connected to the third pole member by a second cord member.

In yet a further embodiment, the at least one attachment device is configured to be attached to a top surface of a watercraft, the at least one attachment device including a pivotal mechanism so as to enable the at least one pole member to rotate relative to the watercraft.

In still a further embodiment, the at least one attachment device is configured to be attached to a peripheral rim of a watercraft cockpit, the at least one attachment device including a first attachment device configured to engage with a first side of the peripheral rim of the watercraft cockpit and a second attachment device configured to engage with a second side of the peripheral rim, the first side of the peripheral rim of the watercraft cockpit being disposed generally opposite to the second side of the peripheral rim of the watercraft cockpit.

In yet a further embodiment, the second attachment device is rotatable relative to the at least one pole member so as to enable the watercraft self-rescue reentry device to be selectively engaged with, and disengaged from, the peripheral rim of the watercraft cockpit.

In still a further embodiment, the foot step is configured to be stowed within an interior cavity of the at least one pole member when the watercraft self-rescue reentry device is not being used.

In yet a further embodiment, the foot step is coupled to the at least one pole member by a plurality of arm members, the plurality of arm members configured to be telescopically received within the at least one pole member, the plurality of arm members configured to be slidingly displaced relative to the at least one pole member between a stowed position where the plurality of arm members are disposed inside the at least one pole member and an extended position where the plurality of arm members extend outwardly from an end of the at least one pole member.

In still a further embodiment, the plurality of arm members comprises a first arm member and a second arm member, the second arm member being pivotably coupled to the first arm member by a hinge joint.

In yet a further embodiment, the foot step is pivotably attached to the second arm member so as to enable the foot step to be rotated between a collapsed position where the foot step is disposed inside the second arm member and an operative position where the foot step is configured to accommodate the foot of the user stepping thereon.

In still a further embodiment, the water anchor device is configured to be stowed within an interior cavity of the at least one pole member when the watercraft self-rescue reentry device is not being used.

In yet a further embodiment, the watercraft self-rescue reentry device further comprises a plurality of pull cords attached to the water anchor device, a first one of the plurality of pull cords configured to collapse the water anchor device prior to the water anchor device being stowed inside the interior cavity of the at least one pole member, and a second one of the plurality of pull cords configured to retract the water anchor device into the interior cavity of the at least one pole member for housing the water anchor device when the water anchor device is not being used.

In still a further embodiment, the watercraft self-rescue reentry device further comprises a pole cap attached to a distal end of the first one of the plurality of pull cords, the pole cap configured to be grasped and pulled by the user so as to facilitate a removal of the water anchor device from the interior cavity of the at least one pole member when the water anchor device is being deployed by the user.

In yet a further embodiment, the watercraft self-rescue reentry device further comprises a weight coupled to the water anchor device, the weight configured to facilitate a sinking of the water anchor device in the water when the water anchor device is initially deployed by the user.

In accordance with one or more other embodiments of the present invention, there is provided a watercraft self-rescue reentry device configured to facilitate a reentry of a user into a watercraft. The watercraft self-rescue reentry device includes at least one pole member having an interior cavity, the at least one pole member including at least one attachment device for attaching the at least one pole member to the watercraft; a foot step coupled to the at least one pole member, the foot step configured to accommodate a foot of a user stepping thereon while the user is attempting to reenter the watercraft from water surrounding the watercraft, the foot step configured to be stowed within a first portion of the interior cavity of the at least one pole member when the watercraft self-rescue reentry device is not being used; and a water anchor device coupled to the at least one pole member, the water anchor device configured to resist a moment applied to the at least one pole member by the user stepping on the foot step, the water anchor device configured to resist the moment applied to the at least one pole member by means of being at least partially immersed in the water, the water anchor device configured to be stowed within a second portion of the interior cavity of the at least one pole member when the watercraft self-rescue reentry device is not being used.

In a further embodiment of the present invention, the at least one pole member comprises a first pole member and a second pole member, the first pole member configured to be attached to the watercraft by the at least one attachment device, and the second pole member configured to be telescopically received within the first pole member, the second pole member configured to be slidingly displaced relative to the first pole member between a stowed position where the second pole member is disposed inside the first pole member and an extended position where the second pole member extends outwardly from an end of the first pole member, the second pole member being coupled to one of the foot step and the water anchor device.

In yet a further embodiment, the at least one pole member comprises a first pole member, a second pole member, and a third pole member, the first pole member configured to be attached to the watercraft by the at least one attachment device, and the second and third pole members each configured to be telescopically received within the first pole member, the second and third pole members configured to be slidingly displaced relative to the first pole member between stowed positions where the second and third pole members are disposed inside the first pole member and extended positions where the second and third pole members extend outwardly from respective ends of the first pole member, the second pole member being coupled to the foot step and the third pole member being coupled to the water anchor device.

In still a further embodiment, the foot step is connected to the second pole member by a first cord member, and the water anchor device is connected to the third pole member by a second cord member.

In yet a further embodiment, the at least one attachment device is configured to be attached to a top surface of a watercraft, the at least one attachment device including a pivotal mechanism so as to enable the at least one pole member to rotate relative to the watercraft.

In still a further embodiment, the at least one attachment device is configured to be attached to a peripheral rim of a watercraft cockpit, the at least one attachment device including a first attachment device configured to engage with a first side of the peripheral rim of the watercraft cockpit and a second attachment device configured to engage with a second side of the peripheral rim, the first side of the peripheral rim of the watercraft cockpit being disposed generally opposite to the second side of the peripheral rim of the watercraft cockpit.

In yet a further embodiment, the second attachment device is rotatable relative to the at least one pole member so as to enable the watercraft self-rescue reentry device to be selectively engaged with, and disengaged from, the peripheral rim of the watercraft cockpit.

In still a further embodiment, the foot step is coupled to the at least one pole member by a plurality of arm members, the plurality of arm members configured to be telescopically received within the at least one pole member, the plurality of arm members configured to be slidingly displaced relative to the at least one pole member between a stowed position where the plurality of arm members are disposed inside the at least one pole member and an extended position where the plurality of arm members extend outwardly from an end of the at least one pole member.

In yet a further embodiment, the plurality of arm members comprises a first arm member and a second arm member, the second arm member being pivotably coupled to the first arm member by a hinge joint.

In still a further embodiment, the foot step is pivotably attached to the second arm member so as to enable the foot step to be rotated between a collapsed position where the foot step is disposed inside the second arm member and an operative position where the foot step is configured to accommodate the foot of the user stepping thereon.

In yet a further embodiment, the watercraft self-rescue reentry device further comprises a plurality of pull cords attached to the water anchor device, a first one of the plurality of pull cords configured to collapse the water anchor device prior to the water anchor device being stowed inside the interior cavity of the at least one pole member, and a second one of the plurality of pull cords configured to retract the water anchor device into the interior cavity of the at least one pole member for housing the water anchor device when the water anchor device is not being used.

In still a further embodiment, the watercraft self-rescue reentry device further comprises a pole cap attached to a distal end of the first one of the plurality of pull cords, the pole cap configured to be grasped and pulled by the user so as to facilitate a removal of the water anchor device from the interior cavity of the at least one pole member when the water anchor device is being deployed by the user.

In yet a further embodiment, the watercraft self-rescue reentry device further comprises a weight coupled to the water anchor device, the weight configured to facilitate a sinking of the water anchor device in the water when the water anchor device is initially deployed by the user.

In still a further embodiment, the watercraft to which the at least one pole member is configured to be attached comprises a kayak or a canoe.

In accordance with yet one or more other embodiments of the present invention, there is provided a watercraft self-rescue reentry device configured to facilitate a reentry of a user into a watercraft. The watercraft self-rescue reentry device includes a collapsible ladder, the collapsible ladder including at least one attachment device at an upper end thereof for attaching the collapsible ladder to the watercraft, the collapsible ladder further including one or more steps for accommodating the feet of a user while the user is attempting to reenter the watercraft from water surrounding the watercraft; and an inflatable bladder attached to the collapsible ladder, the inflatable bladder configured to exert a buoyancy force on the collapsible ladder while the user is attempting to reenter the watercraft so as to facilitate a reentry of the user into the watercraft.

In a further embodiment of the present invention, the at least one attachment device comprises first and second attachment devices configured to be attached to a peripheral rim of a watercraft cockpit, the first attachment device attached to a first longitudinal support member of the collapsible ladder, and the second attachment device attached to a second longitudinal support member of the collapsible ladder, the first longitudinal support member of the collapsible ladder being spaced apart from the second longitudinal support member of the collapsible ladder.

In yet a further embodiment, the inflatable bladder is attached to a rear side of the collapsible ladder; and the collapsible ladder and the inflatable bladder are configured to be rolled together for compact storage of the watercraft self-rescue reentry device.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 1:
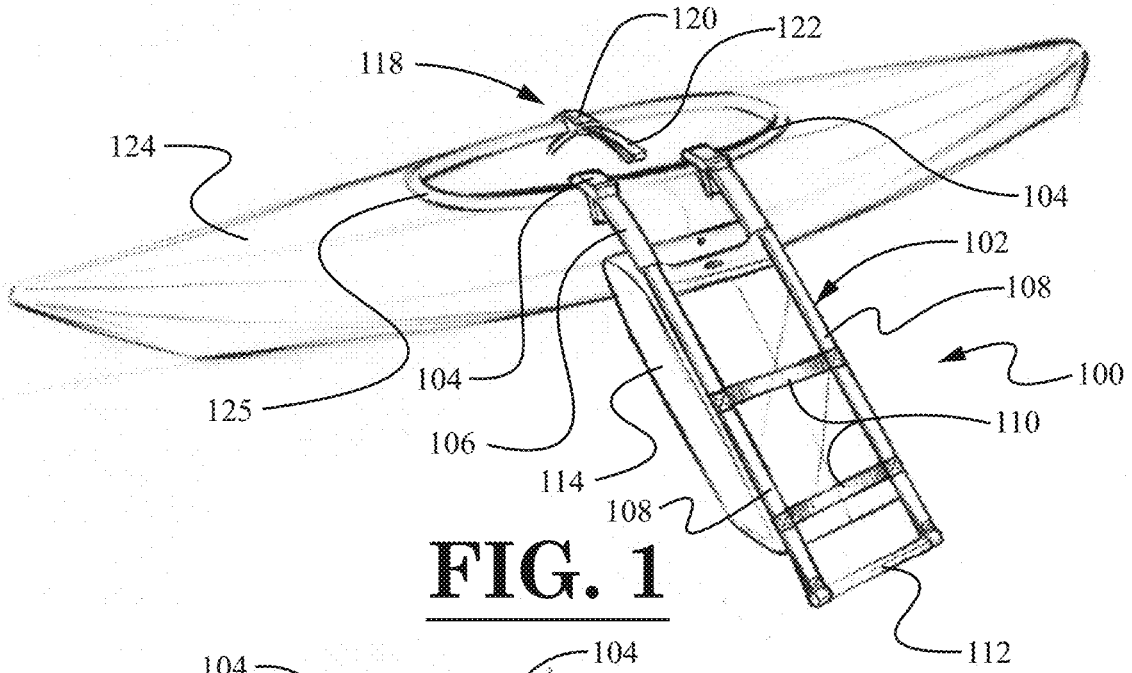
FIG. 1 is a perspective view of a watercraft self-rescue reentry device attached to a kayak, according to one illustrative embodiment of the invention.

An illustrative embodiment of a watercraft self-rescue reentry device, which is configured to facilitate a reentry of a user into a watercraft, is seen generally at 200 in FIGS. 5-10. In this illustrative embodiment, referring initially to FIGS. 5 and 8, the watercraft self-rescue reentry device 200 generally comprises at least one pole member 206, the at least one pole member 206 including at least one attachment device 212, 214 for attaching the at least one pole member 206 to the watercraft; a foot step 202 coupled to the at least one pole member 206, the foot step 202 configured to accommodate a foot of a user stepping thereon while the user is attempting to reenter the watercraft (e.g., kayak 236—see FIG. 7) from water surrounding the watercraft 236 (e.g., from deep water); and a water anchor device 220 coupled to the at least one pole member 206, the water anchor device 220 configured to resist a moment applied to the at least one pole member 206 by the user stepping on the foot step 202, the water anchor device 220 configured to resist the moment applied to the at least one pole member 206 by means of being at least partially immersed in the water (see FIG. 10). In addition to the kayaks 124, 236, 322 depicted in the illustrative embodiments described hereinafter, it is to be understood that the watercraft self-rescue reentry device may also be used with other types of watercrafts for which reentry of the boater into the watercraft may be necessary, such as canoes, small sailboats, or any type of narrow beam watercraft.

Referring again to FIGS. 5 and 9, it can be seen that, in the illustrative embodiment of FIGS. 5-10, the at least one pole member or pole assembly 206 comprises a first pole member 208, a second pole member 210, and a third pole member 211. The first pole member 208 is configured to be attached to the watercraft (e.g., the kayak 236 of FIG. 7) by the at least one attachment device 212, 214. The second pole member 210 is configured to be telescopically received within the first end of first pole member 208 (refer to FIGS. 5 and 7-9). The second pole member 210 is configured to be slidingly displaced relative to the first pole member 208 between a stowed position where the second pole member 210 is disposed inside the first pole member 208 and an extended position where the second pole member 210 extends outwardly from an end of the first pole member 208. As shown in FIGS. 5 and 7-9, the second pole member 210 is coupled to the foot step 202 by means of a first connecting cord 204. The third pole member 211 is configured to be telescopically received within the second end of first pole member 208 (refer to FIG. 9). Similar to the second pole member 210, the third pole member 211 is configured to be slidingly displaced relative to the first pole member 208 between a stowed position where the third pole member 211 is disposed inside the first pole member 208 and an extended position where the third pole member 211 extends outwardly from an end of the first pole member 208. As shown in FIG.

9, the third pole member 211 is coupled to the water anchor device 220 by means of a second connecting cord 222. In the illustrative embodiment, the second and third pole members 210, 211 may slide within respective tracks that are attached to the first pole member 208.

Figure 7:
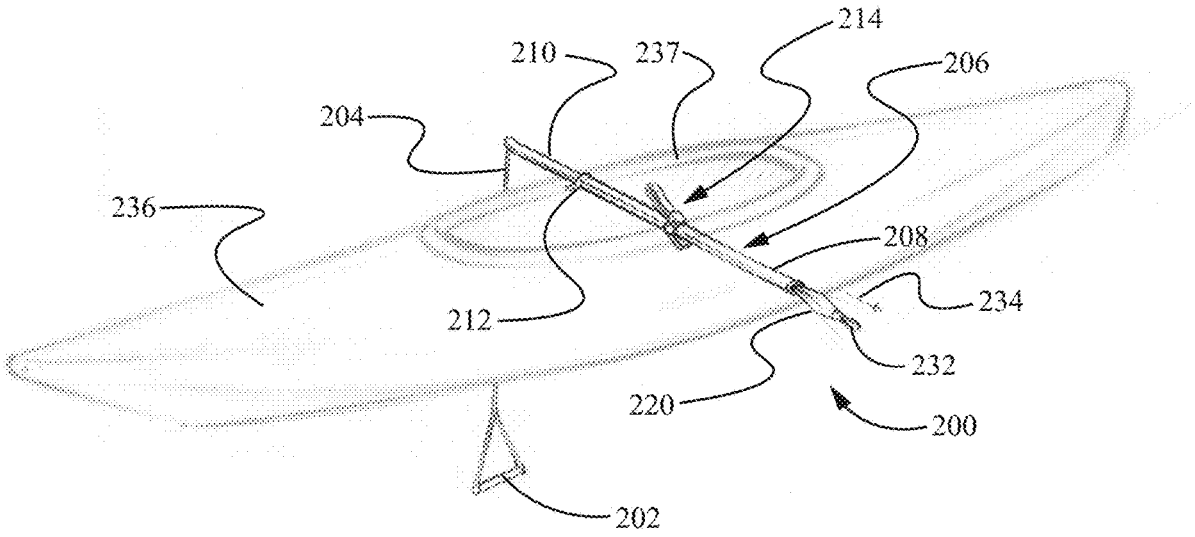
FIG. 7 is a perspective view of the watercraft self-rescue reentry device of FIG. 5 attached to a kayak.
Figure 8:
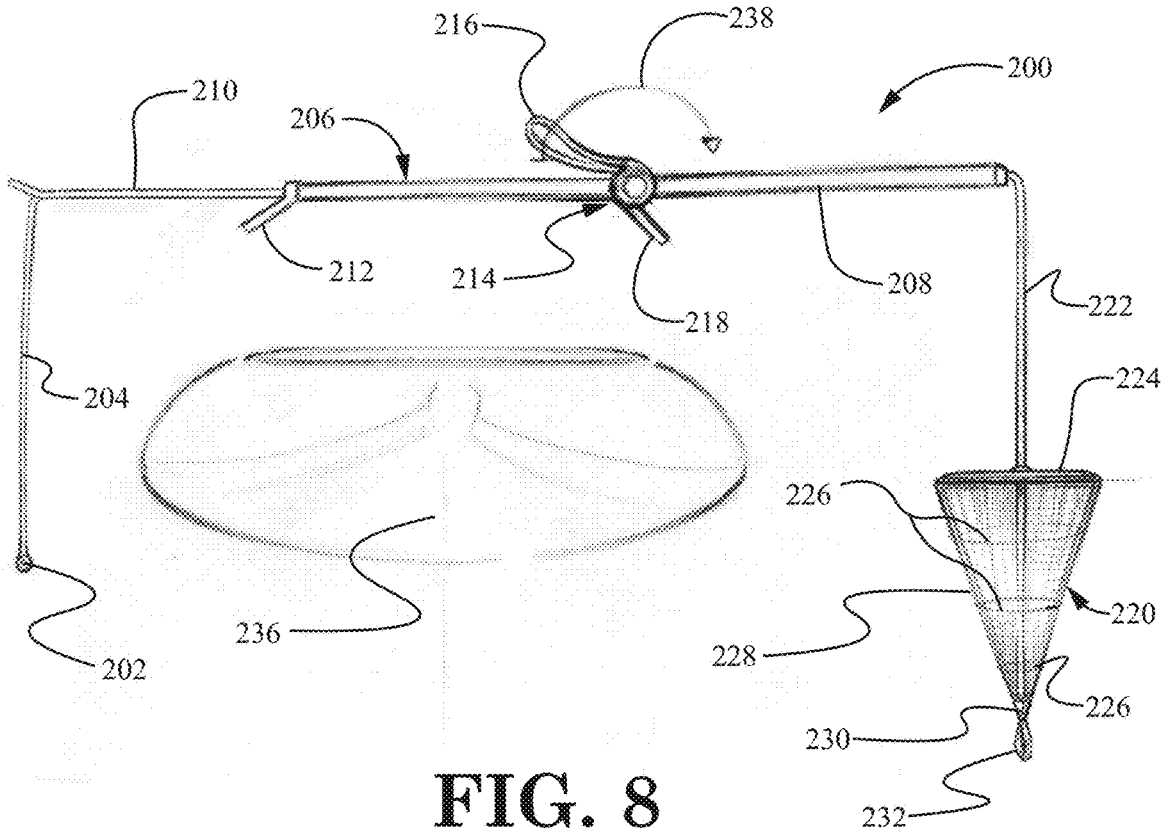
FIG. 8 is a side view of the watercraft self-rescue reentry device of FIG. 5 shown detached from a kayak.

Now, turning to FIGS. 5, 7, and 8, a first illustrative type of attachment mechanism that may be utilized with watercraft self-rescue reentry device 200 will be described. The first type of attachment mechanism enables the watercraft self-rescue reentry device 200 to be temporarily mounted to the watercraft 236 in an easily removable manner (i.e., it allows for the device 200 to be portable). As shown in these figures, the first type of attachment mechanism is configured to be attached to a peripheral rim 237 of a watercraft cockpit (e.g., the cockpit edge 237 of kayak 236—see FIG. 7). The first type of attachment mechanism includes a first attachment device 212 configured to engage with a first side of the peripheral rim 237 of the watercraft cockpit and a second attachment device 214 configured to engage with a second side of the peripheral rim 237 of the watercraft cockpit. As shown in FIG. 7, the first side of the peripheral rim 237 of the watercraft cockpit is disposed generally opposite to the second side of the peripheral rim 237 of the watercraft cockpit. In the illustrative embodiment, the first attachment device 212 is stationary and hooks onto the first side of the peripheral rim 237 of the watercraft cockpit, while the second attachment device 214 is rotatable relative to the first pole member 208 of the pole assembly 206 so as to enable the watercraft self-rescue reentry device 200 to be selectively engaged with, and disengaged from, the peripheral rim 237 of the watercraft cockpit. In its engaged position, the second attachment device 214 hooks onto the second side of the peripheral rim 237 of the watercraft cockpit (see FIG. 7). When a user wants to disengage the second attachment device 214 from the peripheral rim 237 of the watercraft cockpit, he or she grasps the handle portion 216 of the attachment mechanism, and pulls the handle portion 216 in a clockwise rotational direction 238 (refer to FIG. 8) so to disengage the rotatable securement portion 218 of the second attachment device 214 from the second side of the peripheral rim 237 of the watercraft cockpit. The handle portion 216 may also operate as a grab handle for facilitating a user's reentry into the watercraft.

Figure 13:
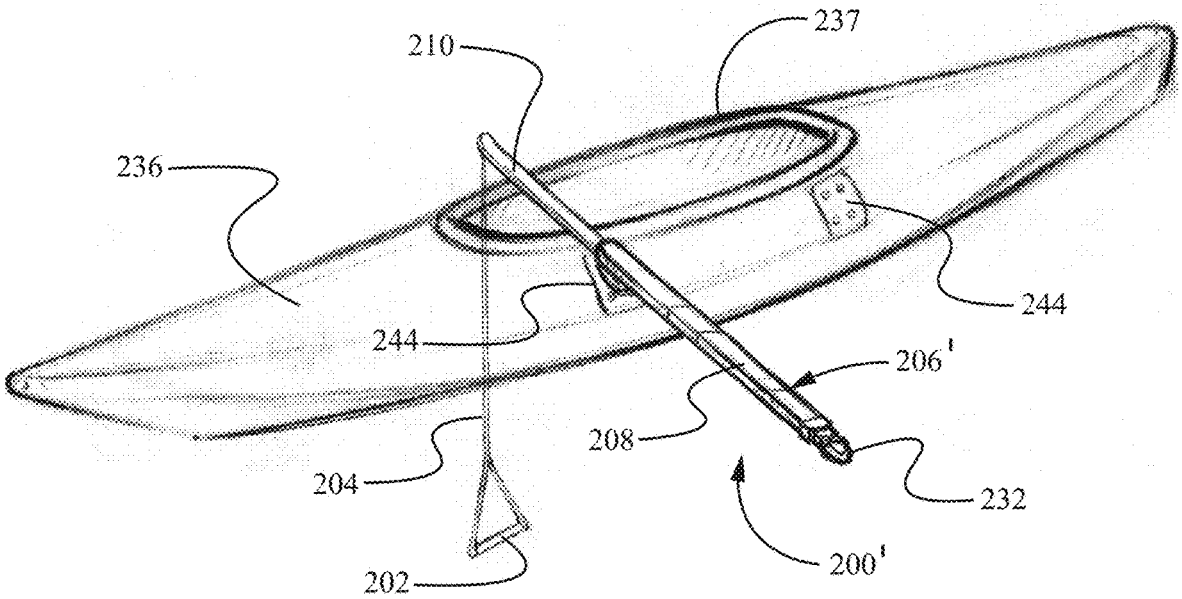
FIG. 13 is a perspective view of the watercraft self-rescue reentry device of FIG. 11 attached to a kayak, wherein the watercraft self-rescue reentry device is in its operative state.
Figure 14:
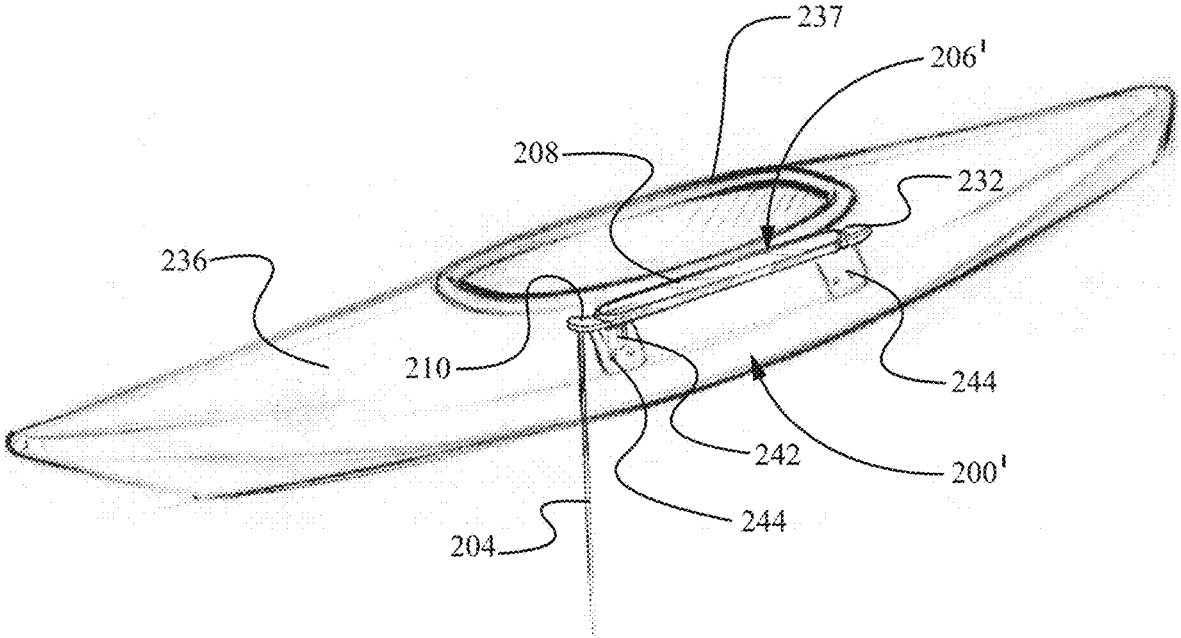
FIG. 14 is another perspective view of the watercraft self-rescue reentry device of FIG. 11 attached to the kayak, wherein the watercraft self-rescue reentry device is in its retracted state.
Figure 15:
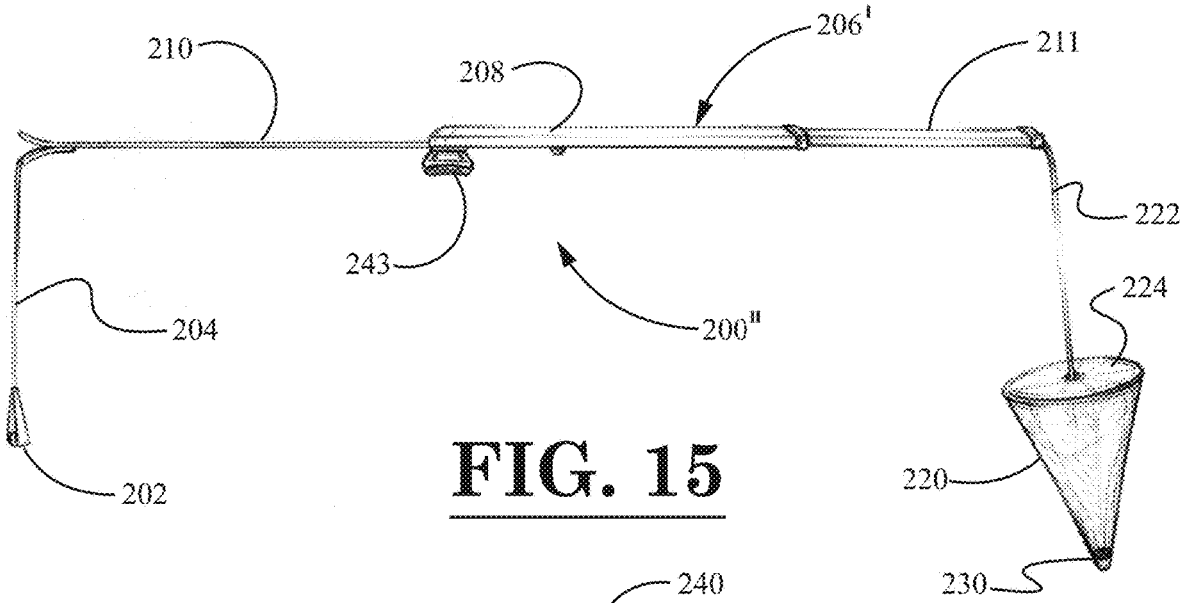
FIG. 15 is a side view of a watercraft self-rescue reentry device, according to still another illustrative embodiment of the invention, wherein the telescoping pole members of the device are shown extended.

Next, referring to the side view of FIG. 9, a second illustrative type of attachment mechanism that may be utilized with watercraft self-rescue reentry device 200' will be explained. Unlike the first type of attachment mechanism described above, the second type of attachment mechanism enables the watercraft self-rescue reentry device 200' to be mounted to the watercraft 236 in a permanent or semi-permanent manner. As shown in these figures, the second type of attachment mechanism is configured to be attached to an upper side surface of a watercraft (e.g., kayak 236). The second type of attachment mechanism, which is in the form of a side mount 242 (see FIG. 9), includes a pivotal mechanism so as to enable the pole assembly 206' to rotate relative to the watercraft. As shown in FIGS. 13 and 14, the pivotal mechanism of the attachment mechanism allows the watercraft self-rescue reentry device to be rotatable between an operative position (i.e., the FIG. 13 position) and a stowed position (i.e., the FIG. 14 position) where the watercraft self-rescue reentry device is unobtrusively stowed along the edge of the watercraft cockpit. Referring again to FIG. 9, it can be seen that the side mount attachment mechanism 242 is attached to a mount base plate 244 via a plurality of fastener members 246 (e.g., screws 246). The mount base plate 244 is mounted on the outer side of the watercraft hull, and the fastener members 246 secure the side mount attachment mechanism 242 to the mount base plate 244. Advantageously, the mounting of the pole assembly 206 on the watercraft 236 relieves the user of having to retrieve the device 200 inside the watercraft 236 when the watercraft 236 has capsized.

Figure 9:
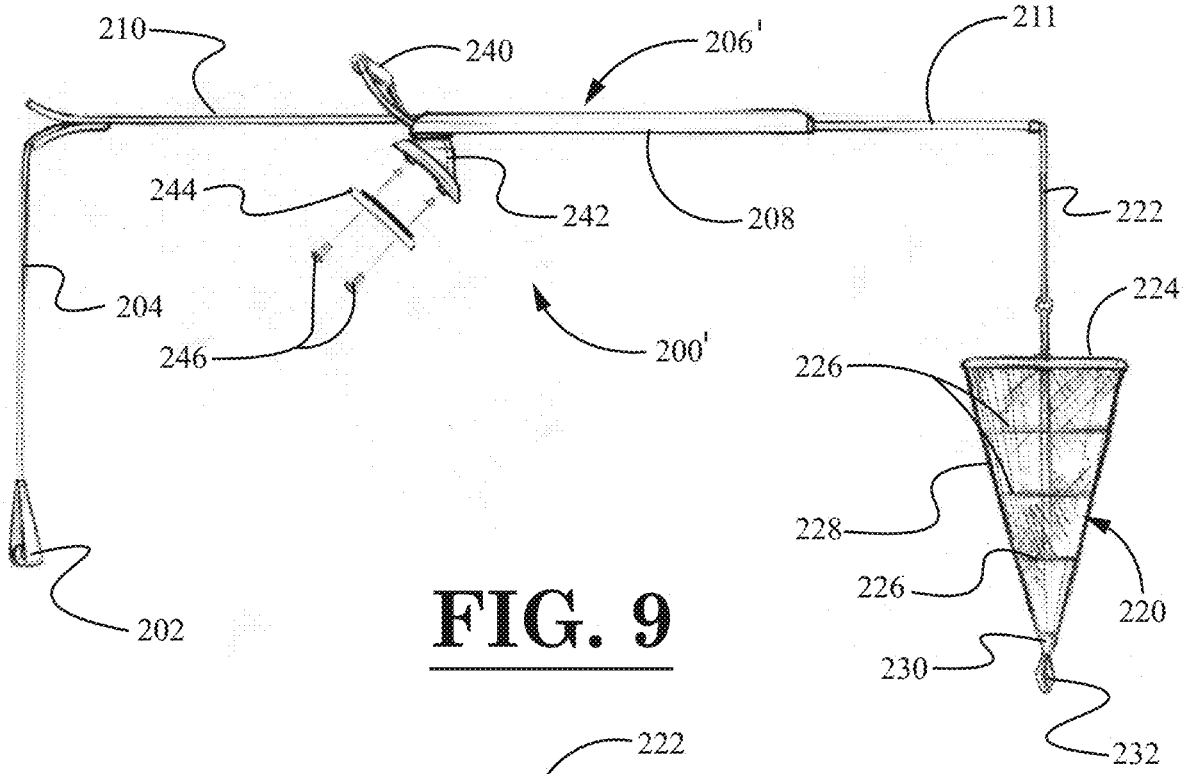
FIG. 9 is another side view of the watercraft self-rescue reentry device of FIG. 5 illustrating the manner in which an alternative permanent side mount of the device is attached to a mount base plate.
Figure 16:
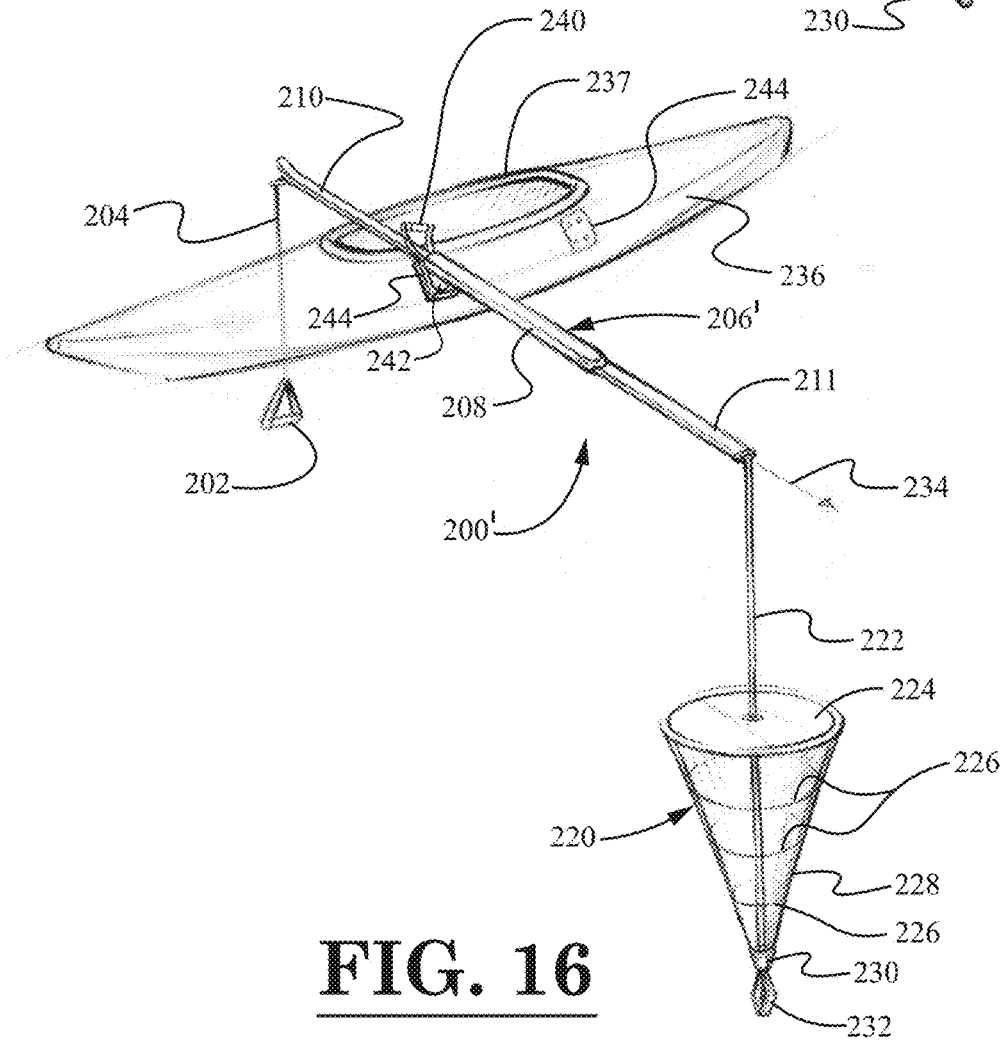
FIG. 16 is a perspective view of the watercraft self-rescue reentry device of FIG. 15 attached to a kayak, wherein the watercraft self-rescue reentry device is shown attached to the kayak in a first side location.

Also, as shown in FIG. 9, the end of the first pole member 208, which is proximate to the foot step 202 may be provided with a grab handle 240 for facilitating a user's reentry into the watercraft. As the user is reentering the watercraft, the user may grasp the handle 240 to make it easier to get back into the cockpit of the watercraft (e.g., see FIG. 16).

Figure 31:
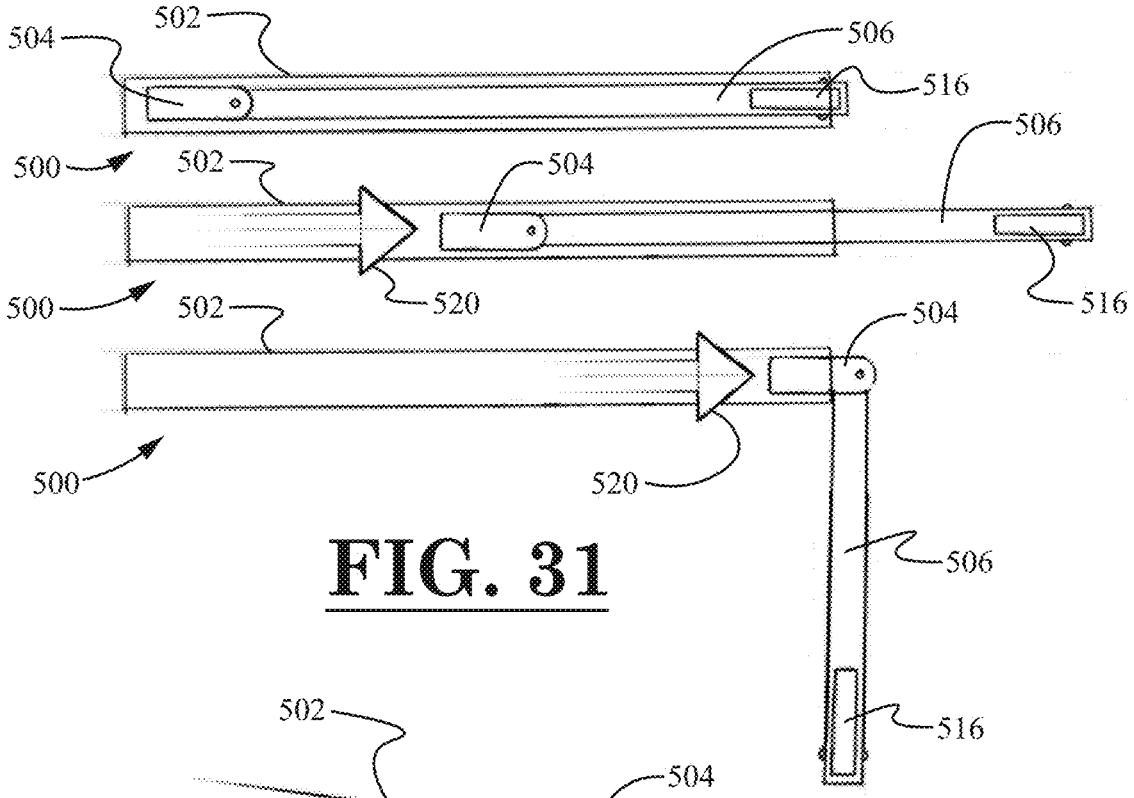
FIG. 31 illustrates exemplary means for deploying a foot step assembly of a watercraft self-rescue reentry device out of a pole member of the device, according to still another illustrative embodiment of the invention.
Figure 32:
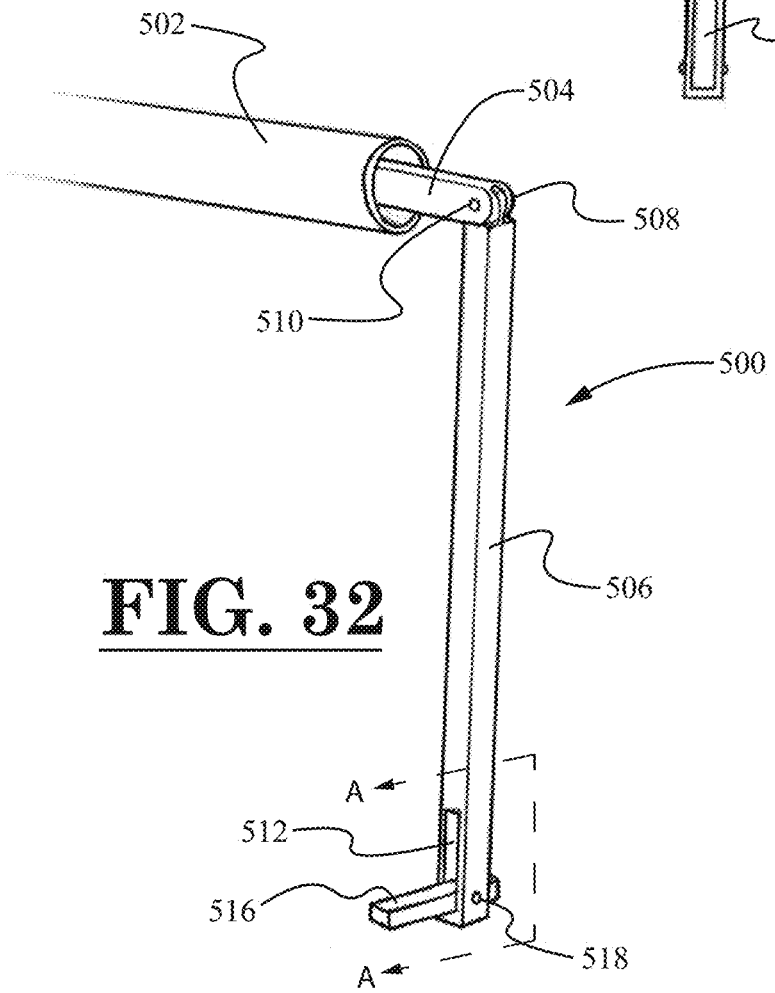
FIG. 32 illustrates the foot step assembly of the watercraft self-rescue reentry device of FIG. 31 in a fully deployed position.

Now, an alternative embodiment of the foot step of the watercraft self-rescue reentry device will be described with reference to FIGS. 31-33. As shown in the perspective view of FIGS. 31 and 32, the deployable foot step assembly 500 is configured to be stowed within an interior cavity of the pole member 502 when the watercraft self-rescue reentry device is not being used. In this illustrative embodiment, the foot step 516 is coupled to the pole member 502 by a plurality of arm members 504, 506. As shown in FIG. 31, the plurality of arm members 504, 506 are configured to be telescopically received within the outer pole member 502. In particular, the plurality of arm members 504, 506 are configured to be slidingly displaced relative to the pole member 502 between a stowed position where the plurality of arm members 504, 506 are disposed inside the pole member 502 and an extended position where the plurality of arm members 504, 506 extend outwardly from an end of the pole member 502 (i.e., the FIG. 32 position). In FIG. 31, the arrow 520 diagrammatically illustrates the slidable configuration of the arm members 504, 506 relative to the pole member 502. In the illustrative embodiment, as shown in FIGS. 31 and 32, the plurality of arm members 504, 506 comprises a first arm member 504 and a second arm member 506. The second arm member 506 is pivotably coupled to the first arm member 504 by a hinge joint 508 with hinge fastener 510. In the illustrative embodiment, as shown in FIG. 31, the first arm member 504 may slide within a track attached to the inside of the pole member 502.

Figure 33:
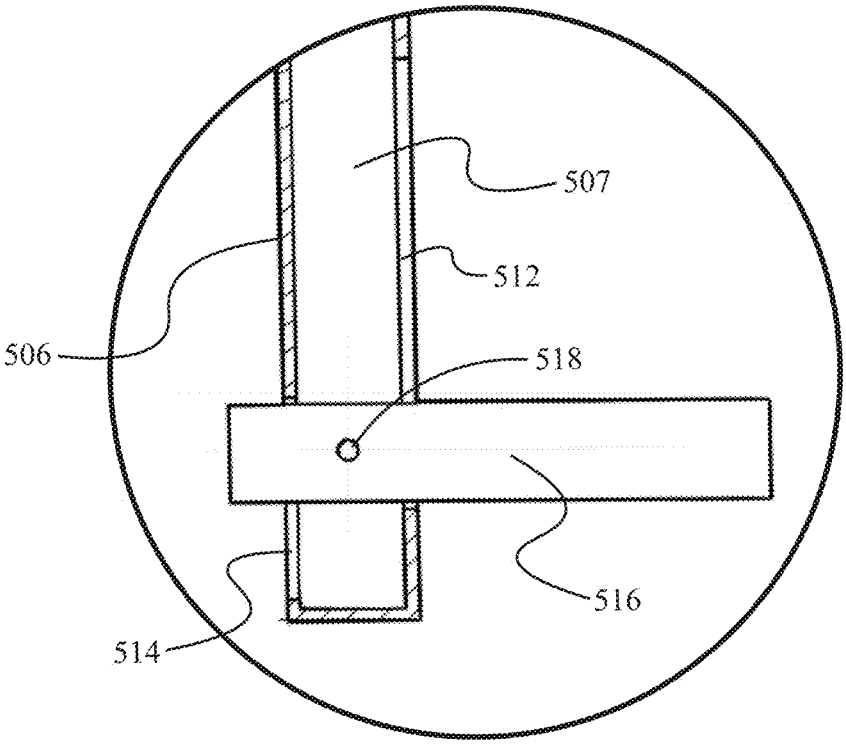
FIG. 33 is a partial longitudinal sectional view of the foot step assembly of the watercraft self-rescue reentry device of FIG. 31, wherein the section is generally cut along the cutting-plane line A-A in FIG. 32.

Turning to FIGS. 32 and 33, it can be seen that, in the illustrative embodiment, the foot step 516 is pivotably attached to the second arm member 506 so as to enable the foot step 516 to be rotated between a collapsed position (i.e., the FIG. 31 position) where the foot step is disposed inside the second arm member 506 and an operative position (i.e., the FIG. 32 position) where the foot step 516 is configured to accommodate the foot of the user stepping thereon. In the stowed position, the foot step 516 is disposed inside the internal cavity 507 of the second arm member 506 such that it does not protrude from the second arm member 506, thereby enabling the second arm member 506 to be slid into the internal cavity of the pole member 502. As shown in FIG. 33, the foot step 516 is pivotally coupled to the second arm member 506 by means of a fastener member 518. When the foot step 516 is ready to be stowed, a user rotates the foot step 516 approximately 90 degrees between the operative position of FIGS. 32 and 33 to the stowed position of FIG. 31. The slots 512, 514 in the oppositely disposed walls of the second arm member 506 allow the foot step 516 to be pivoted about the longitudinal axis of the fastener member 518 without being obstructed by the walls of the second arm member 506.

With combined reference to FIGS. 6-9, the structural details of the illustrative water anchor device 220 of the watercraft self-rescue reentry device 200 will be described.

Figure 5:
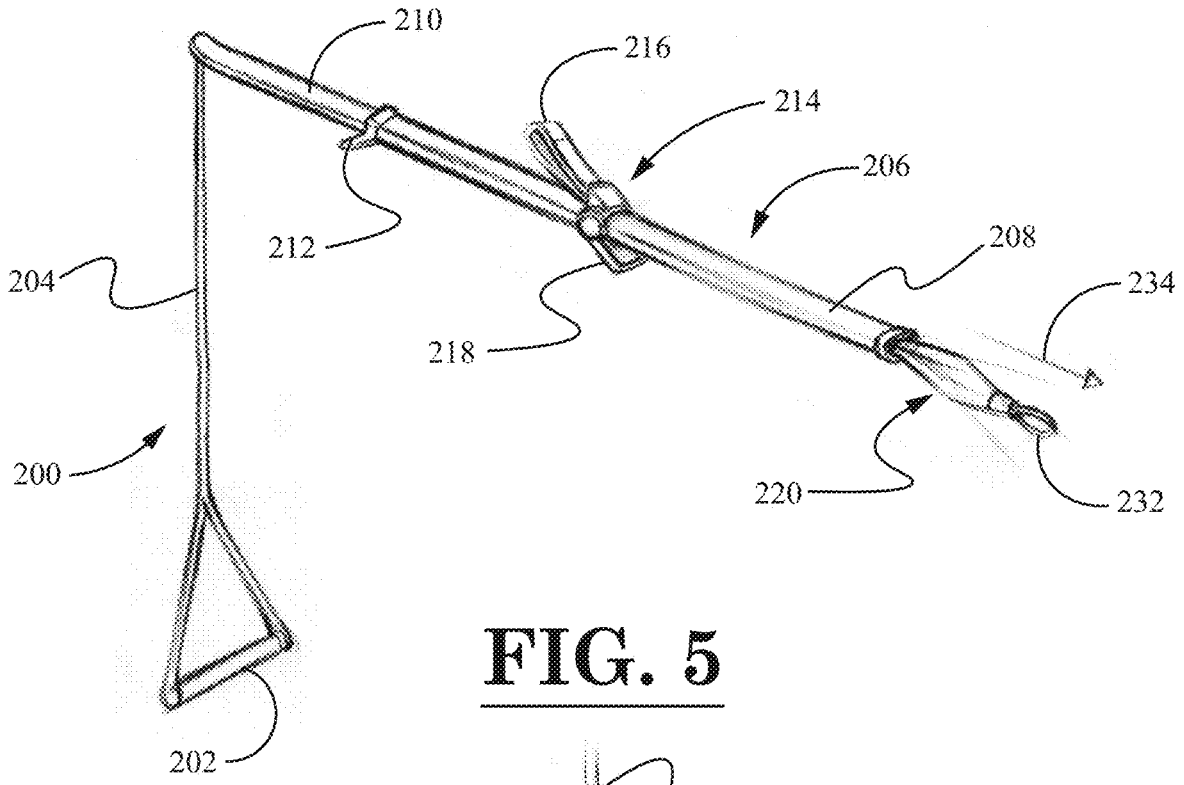
FIG. 5 is a perspective view of a watercraft self-rescue reentry device, according to another illustrative embodiment of the invention.
Figure 6:
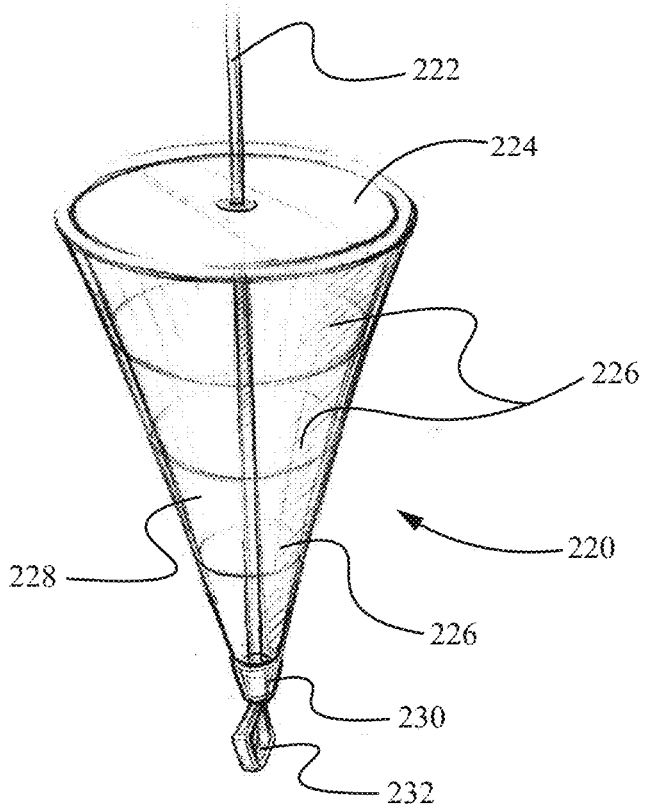
FIG. 6 is a perspective view of a deployable water anchor device of the watercraft self-rescue reentry device of FIG. 5.
Figure 10:
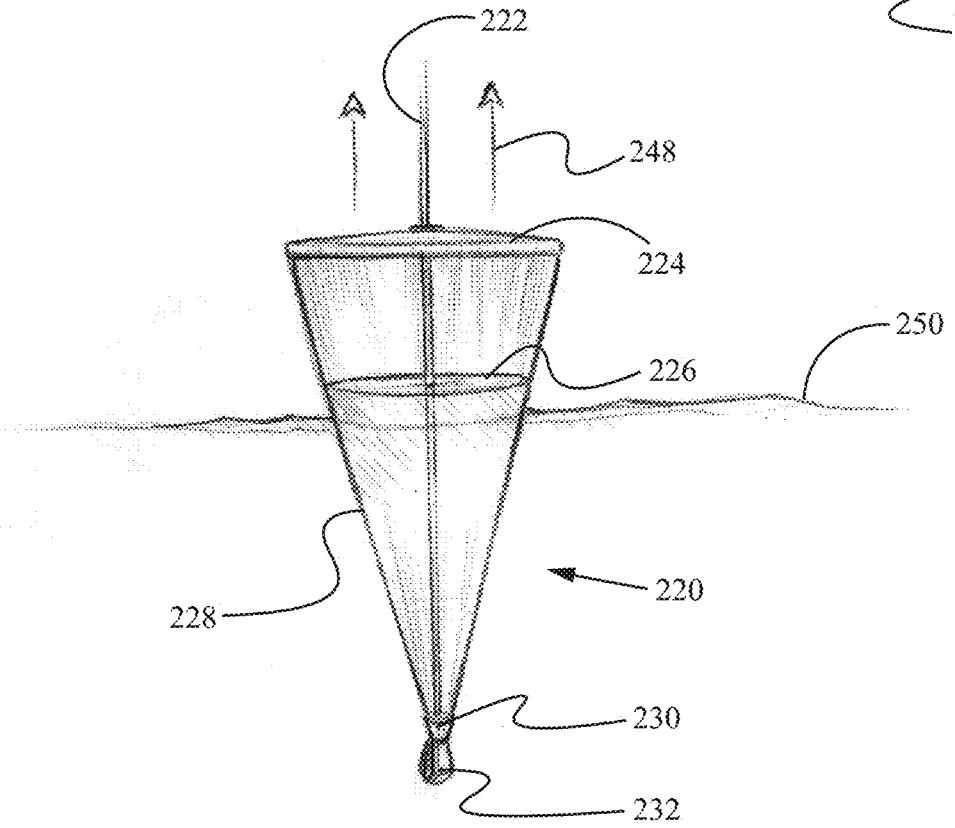
FIG. 10 is another perspective view of a deployable water anchor device of the watercraft self-rescue reentry device of FIG. 5.
Figure 11:
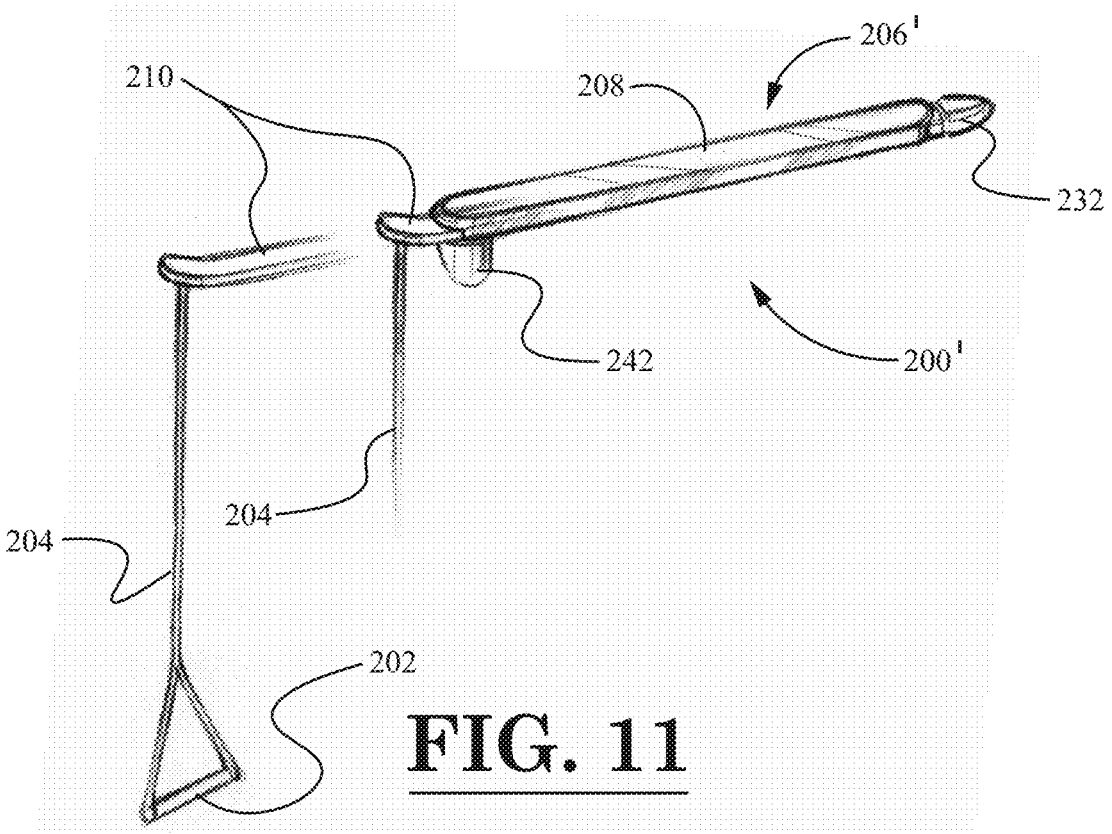
FIG. 11 is a perspective view of a watercraft self-rescue reentry device, according to yet another illustrative embodiment of the invention, wherein the extension of the telescoping pole member is illustrated.

In the illustrative embodiment, as best shown in FIGS. 5 and 7, the water anchor device 220 is configured to be stowed within an interior cavity of the first pole member 208 when the watercraft self-rescue reentry device 200 is not being used. In FIGS. 6, 8, and 9, it can be seen that the water anchor device 220 is generally in the shape of an inverted cone with a top disc member 224, a plurality of intermediate disc members 226, and a water permeable peripheral wall 228 that is attached to, and supported by the disc members 224, 226. In the illustrative embodiment, the water anchor device 220 is in the form of a deployable sea anchor device 220 that resists a pulling force applied thereto (as diagrammatically represented by the arrows 248 in FIG. 10) by at least partially filling with water when placed into a body of water (e.g., as shown in FIG. 10, the sea anchor device 220 is partially submerged below the water surface 250). Also, as shown in FIGS. 6, 8, and 9, a bottom end of the water anchor device 220 may be provided with a handle portion 232 configured to be grasped and pulled by the user so as to facilitate a removal of the water anchor device 220 from the interior cavity of the first pole member 208 when the water anchor device 220 is being deployed by the user. That is, as shown in FIG. 7, when a user is ready to use the watercraft self-rescue reentry device 200, he or she applies a pulling force on the handle portion 232 of the water anchor device 220 (as diagrammatically represented by the arrow 234 in FIG. 7) to remove the water anchor device 220 from the interior cavity of the first pole member 208.

Figure 30:
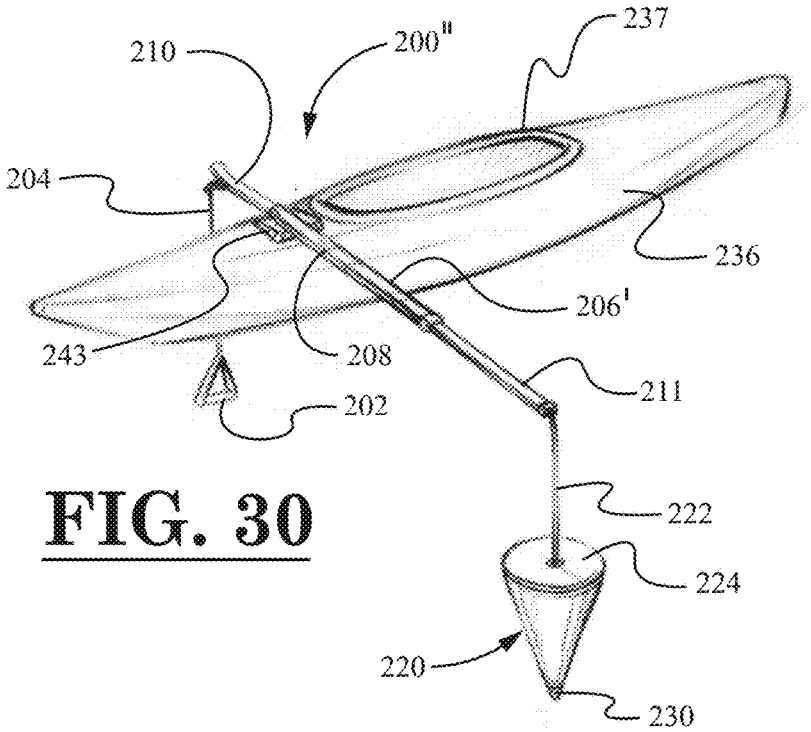
FIG. 30 is a perspective view of the watercraft self-rescue reentry device of FIG. 15, wherein the telescoping pole member attached to the water anchor device is shown extended.

In the illustrative embodiment, cone-shaped water anchor device 220 fills slowly through its water permeable peripheral wall 228 until it is filled enough for the counter torque needed. The downward force on the foot step 202 is countered by the cone-shaped water anchor device 220. Advantageously, the full extension of the device 220, as shown in FIGS. 9 and 30, when mounted to the watercraft allows for increased leverage while the user is entering from the opposite side of the watercraft.

In addition, in the illustrative embodiment, the water anchor device 220 may further comprise a weight 230 proximate to the distal end of the water anchor device 220. The weight 230 is configured to facilitate a sinking of the water anchor device 220 in the water when the water anchor device 220 is initially deployed by the user.

Figure 29:
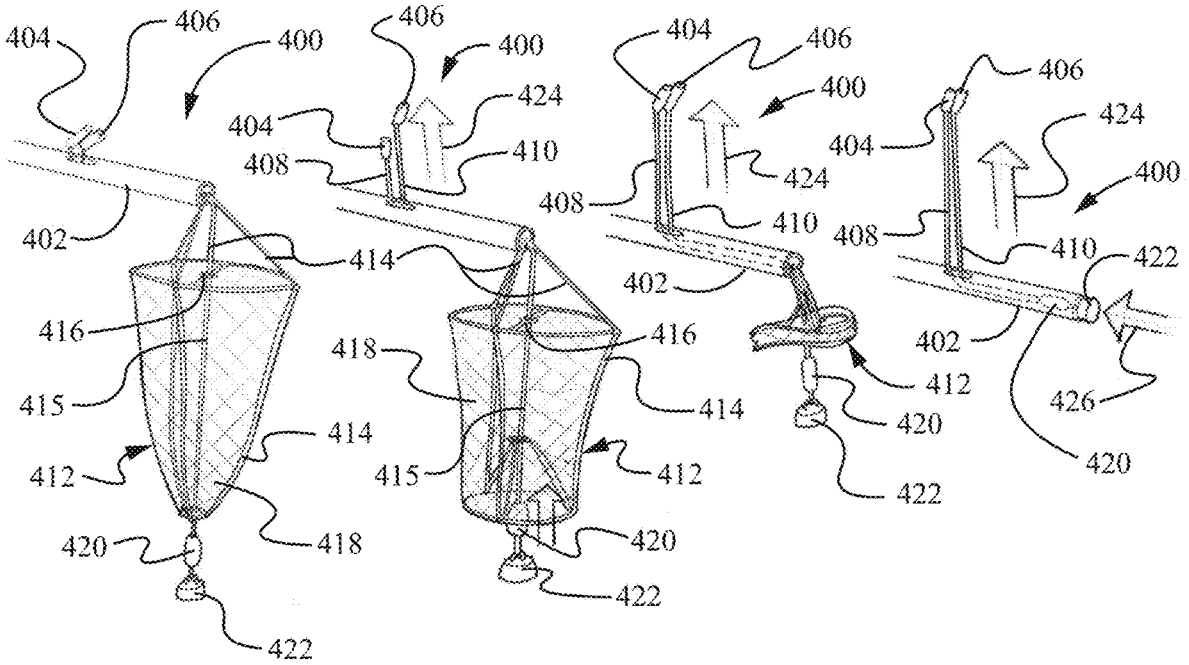
FIG. 29 illustrates exemplary means for emptying water from a water anchor device and for retracting the water anchor device of the watercraft self-rescue reentry device back into a pole member of the device, according to yet another illustrative embodiment of the invention.

Now, an alternative embodiment of the water anchor device of the watercraft self-rescue reentry device will be described with reference to FIG. 29. As shown in the perspective views of FIG. 29, the deployable water anchor system 400 comprises a plurality of pull cords 408, 410 that are attached to the water anchor device 412. A first one 410 of the plurality of pull cords 408, 410 is configured to collapse the water anchor device 412 prior to the water anchor device 412 being stowed inside the interior cavity of the pole member 402. In particular, as shown in FIG. 29, the pull cord 410 is connected to the water anchor device 412 by central connecting cord 415. When a user pulls on the end member 406 of the pull cord 410 (as diagrammatically represented by the arrow 424 in FIG. 29), the water anchor device 412 is inverted and collapsed (refer to second figure from the right in FIG. 29). Thus, advantageously, the cone-shaped water anchor device 412 is designed to dump water with a simple release system built into the pole unit (i.e., the pull cord 410 with end member 406), thus allowing the water anchor device 412 to be compactly stored in the pole member 402. A second one 408 of the plurality of pull cords 408, 410 is configured to retract the water anchor device 412 into the interior cavity of the pole member 402 after it has been collapsed so as to store the water anchor device 412 when the water anchor device 412 is not being used. In particular, as shown in FIG. 29, the pull cord 408 is connected to the water anchor device 412 by the spaced-apart peripheral support cords 414. When a user pulls on the end member 404 of the pull cord 408 (as diagrammatically represented by the arrow 424 in FIG. 29), the water anchor device 412 is retracted into the pole member 402 (refer to the rightmost in FIG. 29).

Similar to the water anchor device 220 described above with regard to FIGS. 6, 8, and 9, it can be seen that the water anchor device 412 also is generally in the shape of an inverted cone with a water permeable peripheral wall 418. As shown in FIG. 29, the water anchor device 412 further comprises a top support member 416 that spans the diameter of the water anchor device 412. A central hole is provided in the top support member 416 for permitting the passage of the central connecting cord 415 therethrough. Also, the deployable water anchor system 400 may further comprise a pole cap 422 attached to a distal end of the central connecting cord 415. The pole cap 422 is configured to be grasped and pulled by the user so as to facilitate a removal of the water anchor device 412 from the interior cavity of the pole member 402 when the water anchor device 412 is being deployed by the user. In addition, as shown in FIG. 29, the pole cap 422 may be pushed into the end of the pole member 402 (as diagrammatically represented by the arrow 426 in FIG. 29) so as to seal the end of the pole member 402 when the water anchor device 412 is being stowed in the interior cavity of the pole member 402. Further, as shown in FIG. 29, similar to the water anchor device 220 described above, the water anchor device 412 may comprise a weight 420 proximate to the distal end of the water anchor device 412 (i.e., attached to the central connecting cord 415). The weight 420 is configured to facilitate a sinking of the water anchor device 412 in the water when the water anchor device 412 is initially deployed by the user. As shown in FIG. 29, the inverted cone-shaped water anchor device 412 comprises a small opening in the bottom end thereof. In one or more embodiments, the opening in the bottom end water anchor device 412 may be provided with a hook-and-loop fastener device so as to allow the size of the opening to be adjusted.

Another illustrative embodiment of the watercraft self-rescue reentry device is seen generally at 200' in FIGS. 11-14. Referring to these figures, it can be seen that, in many respects, the illustrative embodiment of FIGS. 11-14 is similar to the illustrative embodiment described above. Moreover, many elements are common to both such embodiments. For the sake of brevity, the elements that the embodiment of FIGS. 11-14 has in common with the embodiment of FIGS. 5-10 will not be discussed because these components have already been explained in detail above. Furthermore, in the interest of clarity, these elements are denoted using the same reference characters that were used in the embodiment of FIGS. 5-10.

Figure 12:
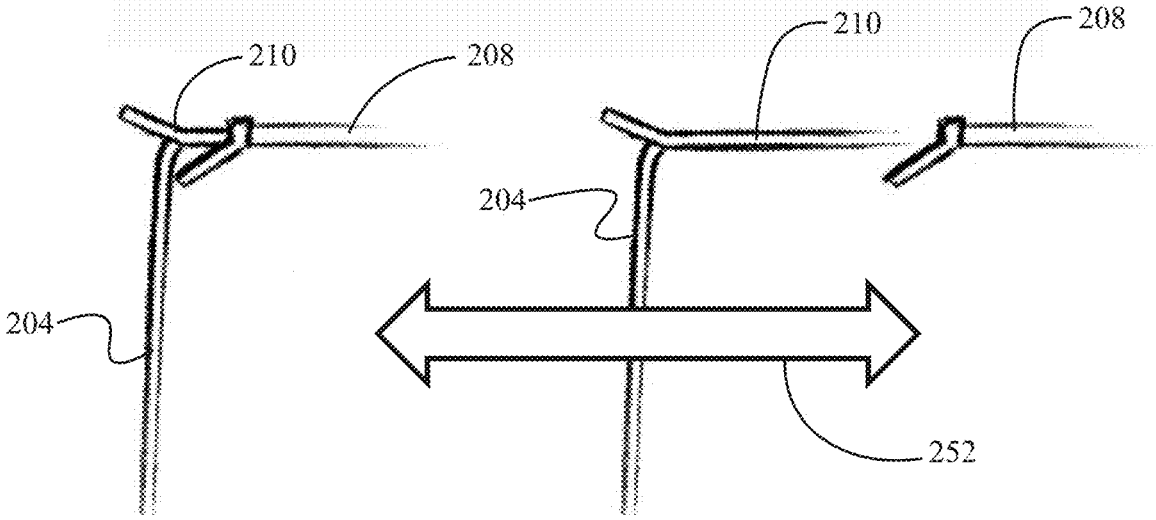
FIG. 12 is a side view of a portion of a watercraft self-rescue reentry device of FIG. 11, wherein the extension of the telescoping pole member is illustrated.

The watercraft self-rescue reentry device 200' of FIGS. 11-14 is generally similar to that of FIGS. 5-10 described above, except that the pole assembly 206' has a slightly different configuration than the pole assembly 206 described above. In particular, the first pole member 208 has a generally rectangular cross-sectional shape, rather than a generally circular cross-sectional shape. Other than this minor difference in the cross-sectional shape of the first pole member 208, the watercraft self-rescue reentry device 200' is generally the same as the watercraft self-rescue reentry device 200. FIG. 12 illustrates the manner in which the second pole member 210 is telescopically received within the first pole member 208 (i.e., the slidable telescopic adjustability of the second pole member 210 is diagrammatically indicated by the arrow 252 in FIG. 12).

Yet another illustrative embodiment of the watercraft self-rescue reentry device is seen generally at 200" in FIGS. 15-23 and 30. Referring to these figures, it can be seen that, in many respects, the illustrative embodiment of FIGS. 15-23 and 30 is similar to the illustrative embodiments described above. Moreover, many elements are common to all of these embodiments. For the sake of brevity, the elements that the embodiment of FIGS. 15-23 and 30 has in common with the embodiments of FIGS. 5-10 and FIGS. 11-14 will not be discussed because these components have already been explained in detail above. Furthermore, in the interest of clarity, these elements are denoted using the same reference characters that were used in the embodiments of FIGS. 5-10 and FIGS. 11-14.

Figure 17:
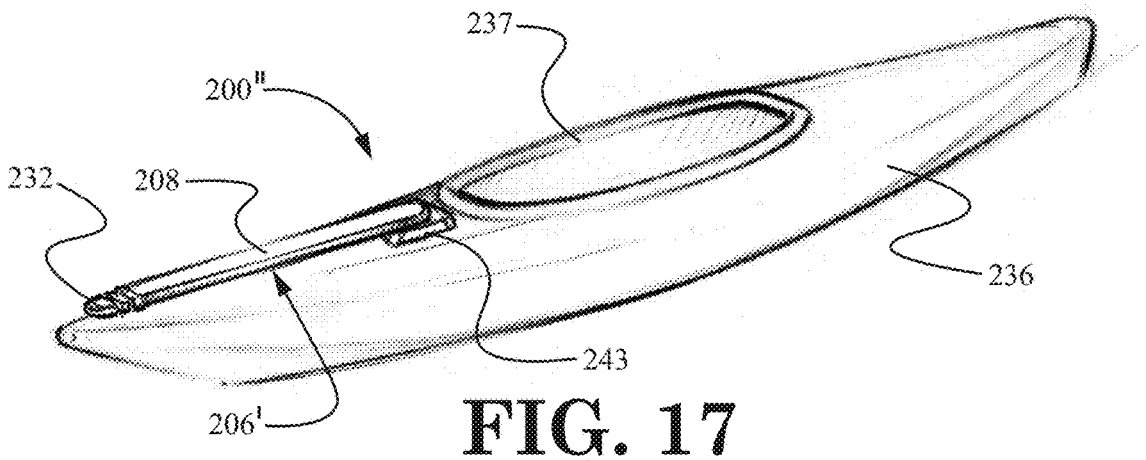
FIG. 17 is a perspective view of the watercraft self-rescue reentry device of FIG. 15 attached to a kayak, wherein the watercraft self-rescue reentry device is shown attached to the kayak in a first top location forward of the kayak cockpit, and the watercraft self-rescue reentry device is shown in a retracted, stowed state.
Figure 18:
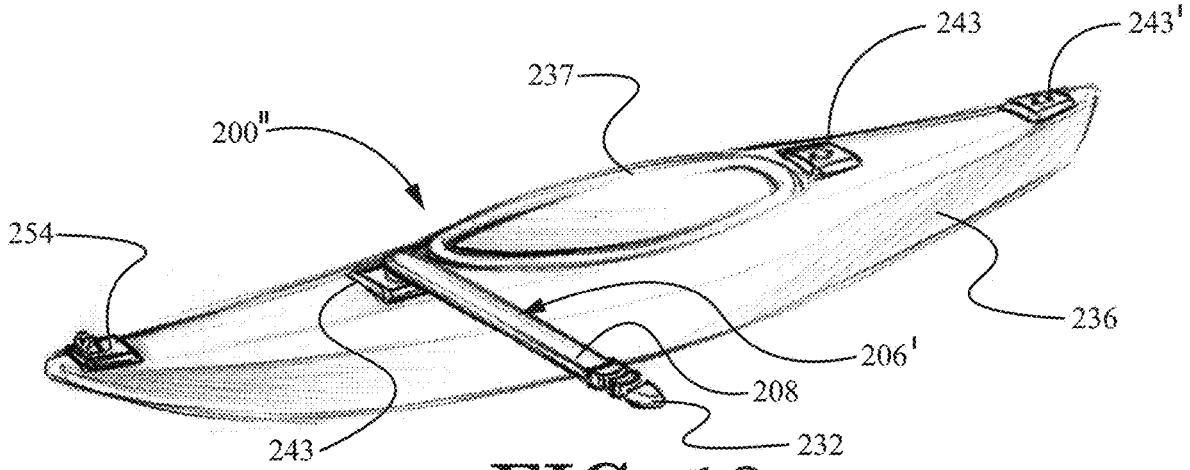
FIG. 18 is a perspective view of the watercraft self-rescue reentry device of FIG. 15 attached to a kayak, wherein the watercraft self-rescue reentry device is shown attached to the kayak in the first top location, and the watercraft self-rescue reentry device is shown in a deployed state.
Figure 19:
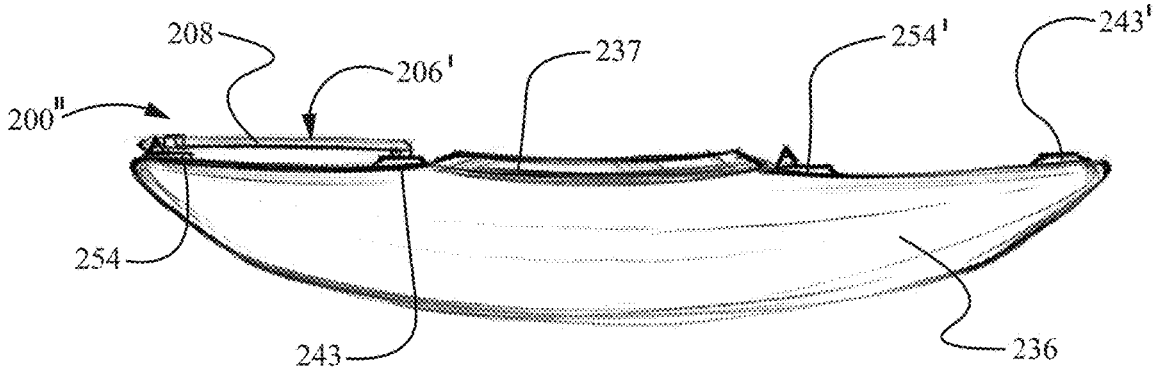
FIG. 19 is a side view of the watercraft self-rescue reentry device of FIG. 15 attached to a kayak, wherein the watercraft self-rescue reentry device is shown attached to the kayak in the first top location, and the watercraft self-rescue reentry device is shown in the retracted, stowed state.

Different mounting configurations for the watercraft self-rescue reentry device 200" are depicted in the illustrative embodiment of FIGS. 15-23 and 30. In FIGS. 17-19, the pole assembly 206' of the watercraft self-rescue reentry device 200" is shown mounted on the bow portion of watercraft 236, forward of the watercraft cockpit. The pivotal end of the pole assembly 206' is secured to the top surface of the watercraft 236, and proximate to the forward end of the cockpit, by top mount 243. Also, as shown in these figures, a support rest 254 may be provided on the bow of the watercraft 236 to support the end of the pole assembly 206' opposite the mount 243. In FIGS. 17 and 19, the pole assembly 206' of the watercraft self-rescue reentry device 200" is shown in its stowed position extending along the longitudinal centerline of the watercraft 236, while the pole assembly 206' of the watercraft self-rescue reentry device 200" is shown in its rotated, operative position in FIG. 18 where the pole assembly 206' extends outwardly from the side of the watercraft 236 at generally a 90 degree angle.

Figure 20:
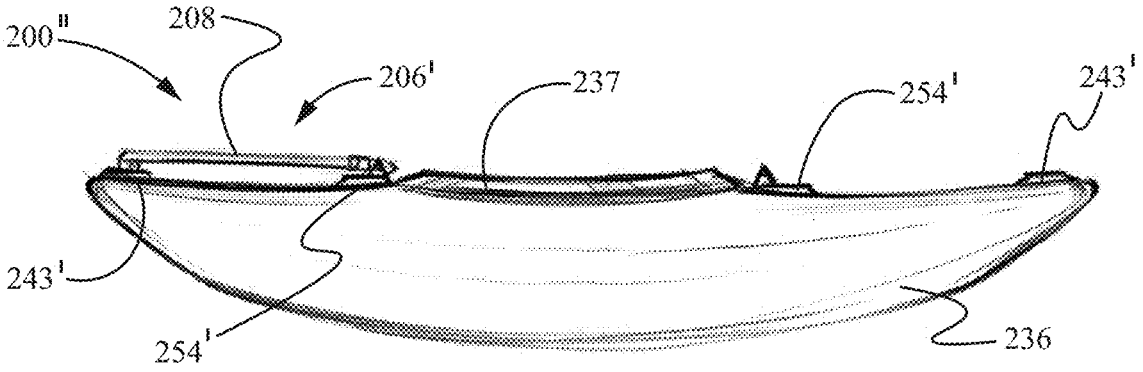
FIG. 20 is a side view of the watercraft self-rescue reentry device of FIG. 15 attached to a kayak, wherein the watercraft self-rescue reentry device is shown attached to the kayak in a second top location forward of the kayak cockpit, and the watercraft self-rescue reentry device is shown in a retracted, stowed state.
Figure 21:
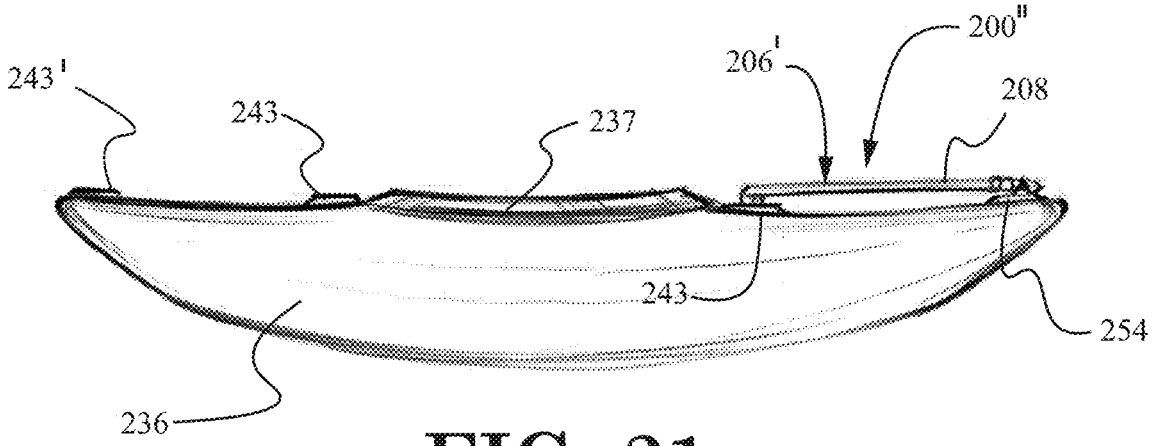
FIG. 21 is a side view of the watercraft self-rescue reentry device of FIG. 15 attached to a kayak, wherein the watercraft self-rescue reentry device is shown attached to the kayak in a third top location rearward of the kayak cockpit, and the watercraft self-rescue reentry device is shown in a retracted, stowed state.
Figure 22:
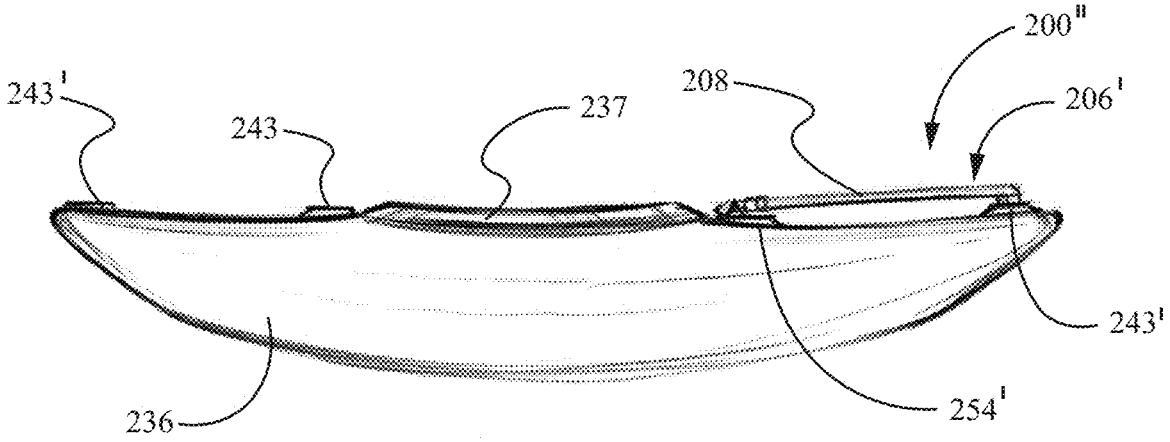
FIG. 22 is a side view of the watercraft self-rescue reentry device of FIG. 15 attached to a kayak, wherein the watercraft self-rescue reentry device is shown attached to the kayak in a fourth top location rearward of the kayak cockpit, and the watercraft self-rescue reentry device is shown in a retracted, stowed state.

Additional mounting configurations for the watercraft self-rescue reentry device 200" are shown in FIGS. 20-22. In FIG. 20, the pivotal end of the pole assembly 206' is secured to the top surface of the watercraft 236, and proximate to the bow end of the watercraft 236, by top mount 243'. Also, as shown in this figure, a support rest 254' may be provided at the forward end of the watercraft cockpit to support the end of the pole assembly 206' opposite the mount 243'. FIG. 20 additionally illustrates other possible locations for the top mount 243' and the support rest 254' on the stern portion of the watercraft 236, aft of the watercraft cockpit (i.e., with the top mount 243' at the stern end of the watercraft 236 and the support rest 254' at the aft end of the watercraft cockpit). In FIG. 21, the pivotal end of the pole assembly 206' is secured to the top surface of the watercraft 236, and proximate to the aft end of the cockpit, by top mount 243. Also, as shown in this figure, a support rest 254 may be provided at the stern end of the watercraft 236 to support the end of the pole assembly 206' opposite the mount 243. FIG. 21 also illustrates alternative mounting locations for the top mounts 243, 243' on the bow portion of the watercraft 236. In FIG. 22, the pivotal end of the pole assembly 206' is secured to the top surface of the watercraft 236, and proximate to the stern of the stern end of the watercraft 236, by top mount 243'. Also, as shown in this figure, a support rest 254' may be provided at the aft end of the watercraft cockpit to support the end of the pole assembly 206' opposite the mount 243'. Similar to FIG. 21, FIG. 22 illustrates alternative mounting locations for the top mounts 243, 243' on the bow portion of the watercraft 236.

Figure 23:
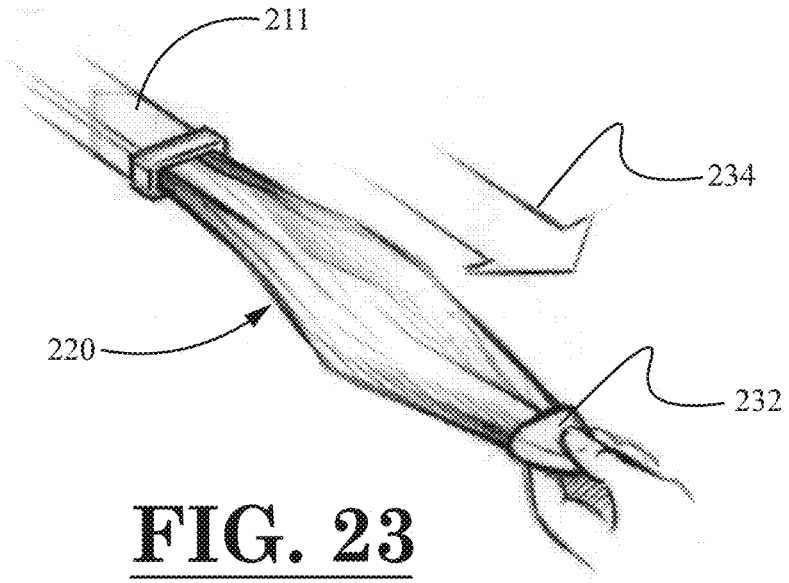
FIG. 23 is a perspective view of an end portion of the watercraft self-rescue reentry device of FIG. 15, wherein the deployment of the water anchor device by a user is being illustrated.

FIG. 23 illustrates the deployment of the water anchor device 220 from the interior cavity of the third pole member 211 by means of a user grasping the end 232 of the water anchor device 220. FIG. 30 illustrates the watercraft self-rescue reentry device 200" in its operative position, wherein the foot step 202 is disposed on a first side of the watercraft 236 and the water anchor device 220 is disposed on a second side of the watercraft 236.

Now, an illustrative manner in which the watercraft self-rescue reentry device described herein is utilized by a user to reenter a watercraft will be described with reference to FIGS. 24-28. The illustrative embodiment of the watercraft self-rescue reentry device 300 depicted in FIGS. 24-28 is similar in many respects to the embodiments of the watercraft self-rescue reentry device described above. Moreover, many elements are common to all of these embodiments. For the sake of brevity, the elements that the embodiment of FIGS. 24-28 has in common with the preceding embodiments will not be discussed in detail because these components have already been described above.

Figure 24:
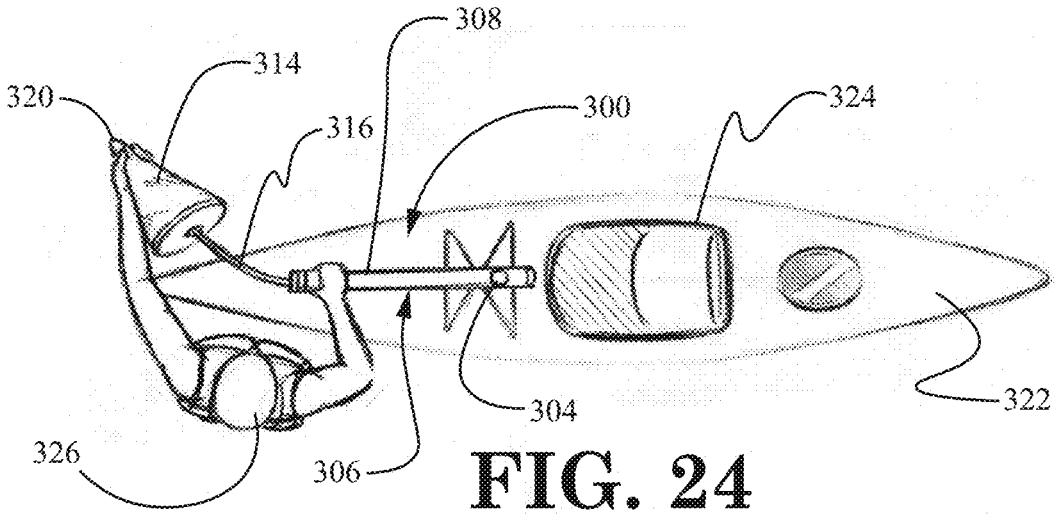
FIG. 24 is a top plan view depicting a first step in an illustrative method of using a watercraft self-rescue reentry device, wherein the water anchor device is being pulled out from its stowed position by a user.
Figure 25:
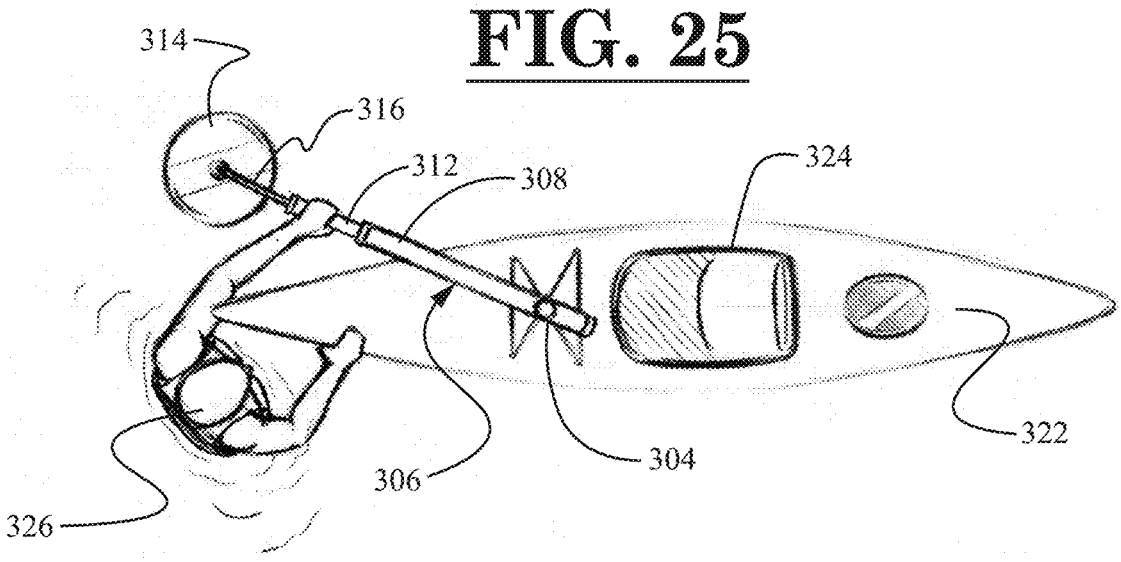
FIG. 25 is a top plan view depicting a second step in the illustrative method of using the watercraft self-rescue reentry device, wherein the user is rotating the pole assembly to its side momentum resisting position.
Figure 26:
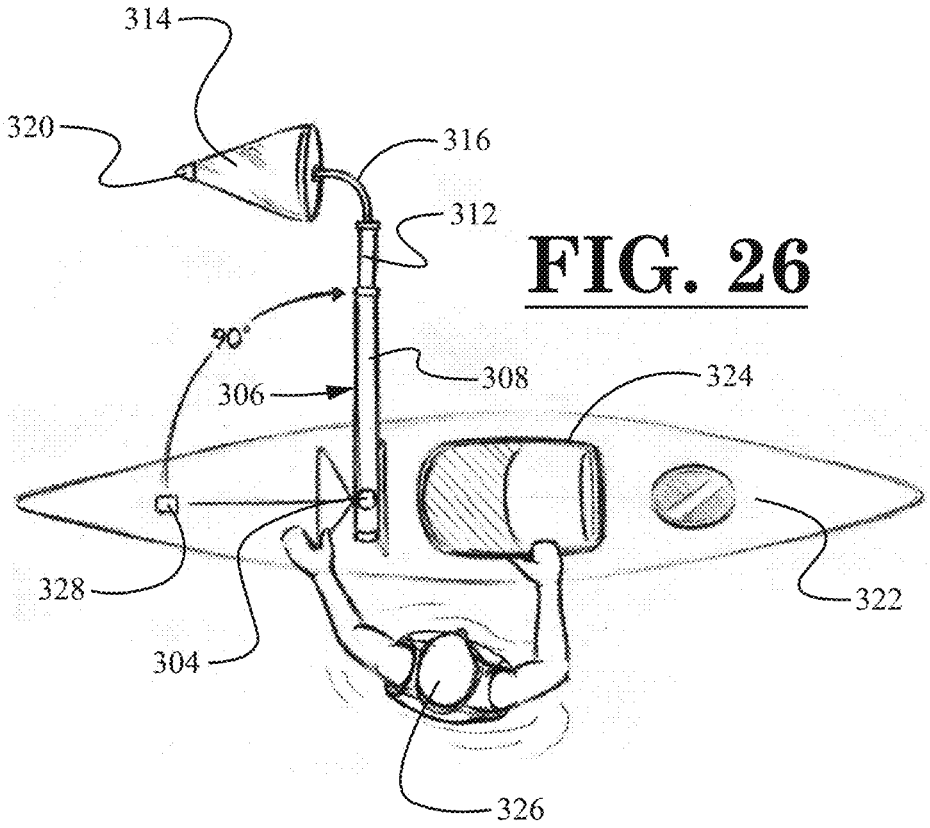
FIG. 26 is a top plan view depicting a third step in the illustrative method of using the watercraft self-rescue reentry device, wherein the pole assembly is fixed in its deployed position perpendicular to the watercraft and the water anchor device is beginning to fill with water.
Figure 27:
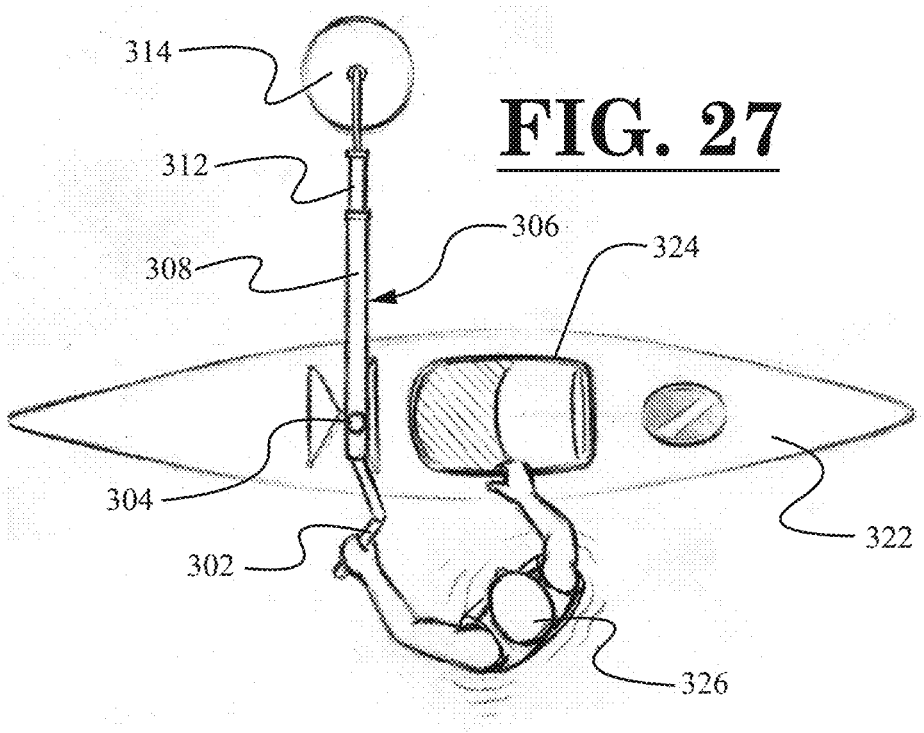
FIG. 27 is a top plan view depicting a fourth step in the illustrative method of using the watercraft self-rescue reentry device, wherein the user is removing and extending the foot step.
Figure 28:
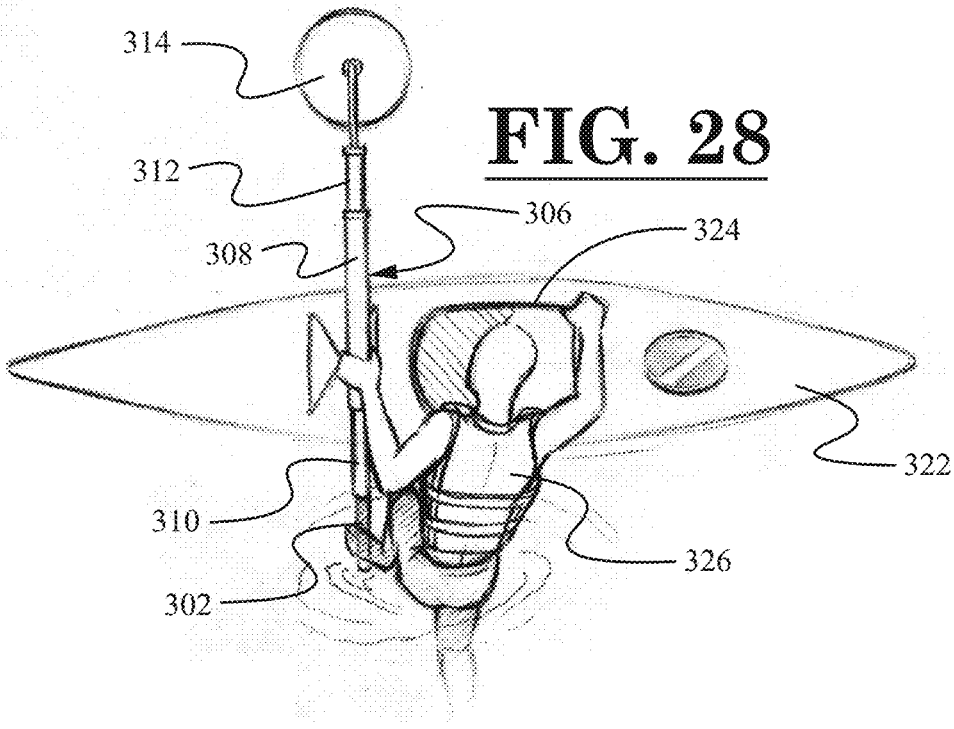
FIG. 28 is a top plan view depicting a fifth step in the illustrative method of using the watercraft self-rescue reentry device, wherein the foot of the user is disposed on the foot step and the user is beginning to reenter the watercraft.

First of all, with reference to FIG. 24, in order to reenter the watercraft 322 (e.g., a kayak 322) using the watercraft self-rescue reentry device 300, a user 326 first swims to the front of the watercraft 322 and pulls out the water anchor device 314 from the interior of the pole assembly 306. Then, as shown in FIG. 25, the user 326 unlatches the pole assembly 306 from the watercraft 322 (e.g., from support rest 328—see FIG. 26), and pushes the pole assembly 306 away from the watercraft 322 so as to rotate the pole assembly 306 about its pivot support 304. Also, in FIG. 25, it can be seen that the user 326 also extends the telescoping pole member 312 from the base pole member 308 of the pole assembly 306, and fills the water anchor device 314 with water. Similar to the embodiments described above, the water anchor device 314 is coupled to the telescoping pole member 312 by means of a connecting cord 316. The weighted bottom end 320 of the water anchor device 314 facilitates the filling of the water anchor device 314 with water. Next, as shown in FIG. 26, the user 326 swims to the side of the watercraft 322, positions the pole assembly 306 in a 90 degree position relative to the watercraft 322, and locks the pole assembly 306 in place (e.g., by means of engaging a latching mechanism at the pivot support 304). After which, as depicted in FIG. 27, the user 326 extends the telescoping pole member 310 from the base pole member 308 of the pole assembly 306, pulls out the foot step 302, and locks the foot step 302 into position (e.g., by means of engaging a latching mechanism at the foot step 302). Finally, as shown in FIG. 28, the user 326 places his or her left foot onto foot step 302, grasps the swivel support 304 with his or her left hand, grasps the edge 324 of the watercraft cockpit with his or her right hand, and pushes with his or her left foot. The user 326 then pulls with his hands to reenter the watercraft 322.

Still another illustrative embodiment of the watercraft self-rescue reentry device is seen generally at 100 in FIGS. 1-4. In this illustrative embodiment, referring initially to FIGS. 1 and 2, the watercraft self-rescue reentry device 100 generally comprises a collapsible ladder 102, the collapsible ladder 102 including at least one attachment device 104 at an upper end thereof for attaching the collapsible ladder to the watercraft (e.g., kayak 124—see FIGS. 1 and 3), the collapsible ladder 102 further including one or more steps 110 for accommodating the feet of a user 126 while the user 126 is attempting to reenter the watercraft 124 from water surrounding the watercraft 124 (see FIG. 3); and an inflatable bladder 114 attached to the collapsible ladder 102, the inflatable bladder 114 configured to exert a buoyancy and stabilizing force on the collapsible ladder 102 while the user 126 is attempting to reenter the watercraft 124 so as to facilitate a reentry of the user 126 into the watercraft 124 (see FIG. 3).

Figure 2:
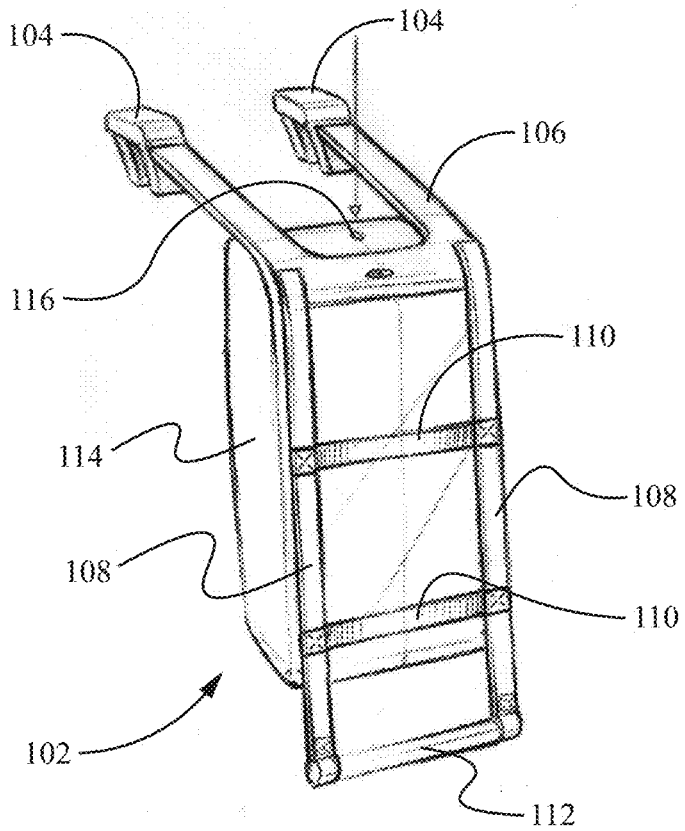
FIG. 2 is a perspective view of the watercraft self-rescue reentry device of FIG. 1.

With combined reference to FIGS. 1 and 2, it can be seen that, in the illustrative embodiment, the at least one attachment device 104 comprises first and second clamp members 104 configured to be attached to a peripheral rim 125 of a watercraft cockpit (see FIG. 1). The first clamp member 104 is attached to a first longitudinal support member 108 of the collapsible ladder 102 (i.e., to the first vertical support member 108 of the ladder 102). The second clamp member 104 is attached to a second longitudinal support member 108 of the collapsible ladder 102 (i.e., to the second vertical support member 108 of the ladder 102). As shown in FIGS. 1 and 2, the first longitudinal support member 108 of the collapsible ladder 102 is spaced apart from the second longitudinal support member 108 of the collapsible ladder 102. A top support member 106 is attached to the upper ends of the longitudinal support members 108 of the ladder 102, while the lower ends of the longitudinal support members 108 of the ladder 102 are connected by the bottom step 112. A plurality of intermediate steps or climbing/grasping straps 110 are provided between the top support member 106 and the bottom step 112 (see FIGS. 1 and 2).

Figure 3:
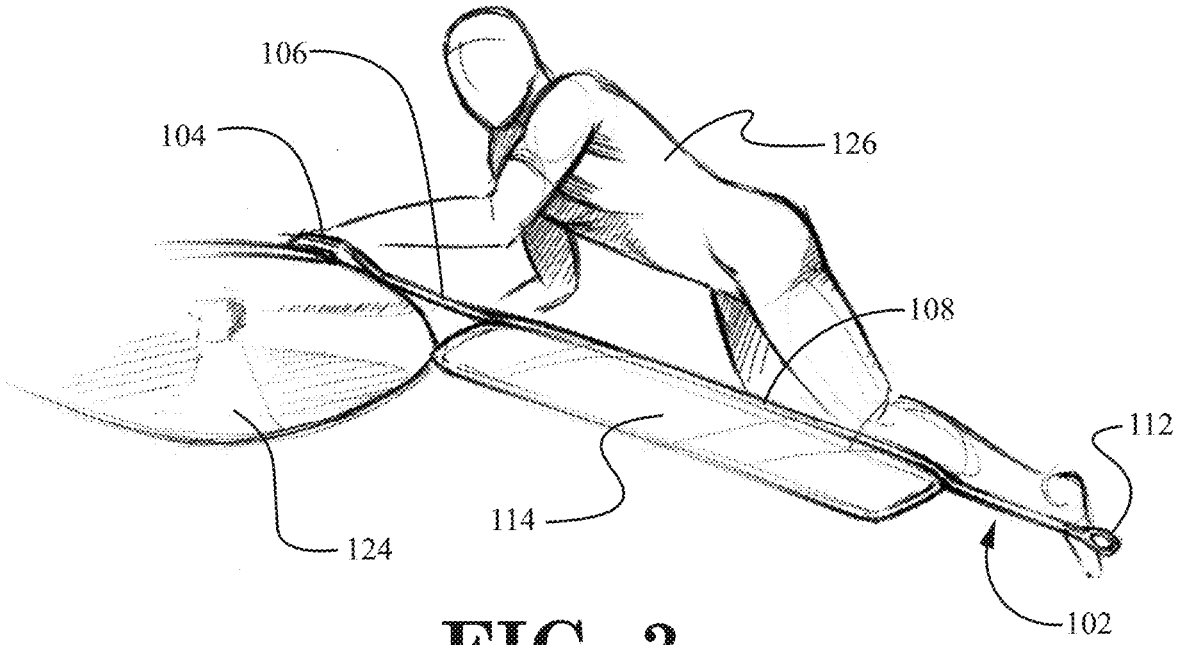
FIG. 3 illustrates the manner in which the watercraft self-rescue reentry device of FIG. 1 is used to reenter a kayak.
Figure 4:
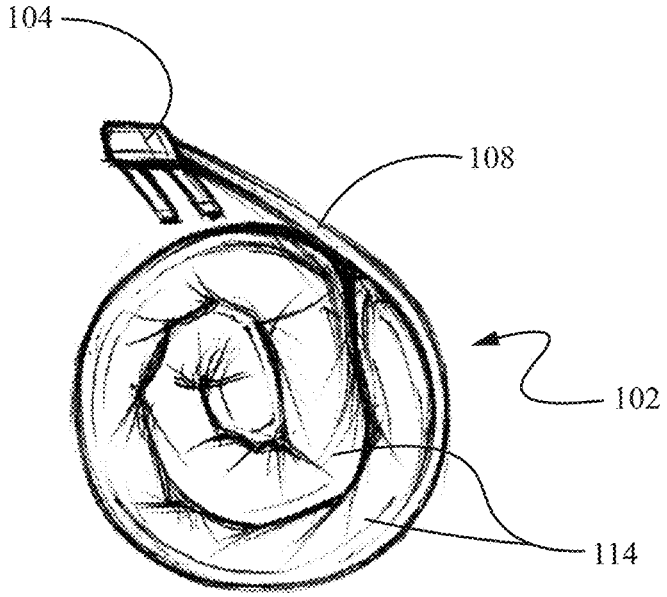
FIG. 4 illustrates a rolled configuration of the watercraft self-rescue reentry device of FIG. 1 for compact storage of the device.

As shown in FIGS. 1-3, in the illustrative embodiment, the inflatable bladder 114 is attached to a rear side of the collapsible ladder 102. The inflatable bladder 114 comprises a fill port 116 at the top thereof (see FIG. 2) for filling the inflatable bladder 114 with a suitable fluid, such as air or carbon dioxide ($CO_2$). Referring to FIG. 4, it can be seen that the collapsible ladder 102 and the inflatable bladder 114 are configured to be rolled together for compact storage of the watercraft self-rescue reentry device 100 (e.g., after the inflatable bladder 114 has been deflated or at least partially deflated).

Turning again to FIG. 1, it can be seen that the watercraft self-rescue reentry device 100 may further include a handle device 118 for facilitating a user's reentry into the watercraft 124. As the user is reentering the watercraft 124, the user 126 may grasp the handle portion 122 of the handle device 118 to make it easier to get back into the cockpit of the watercraft. In the illustrative embodiment, it can be seen that the handle device 118 may include a clamp portion 120 for attaching the handle device 118 to the peripheral rim 125 of the watercraft cockpit (see FIG. 1). For example, as shown in the illustrative embodiment of FIG. 1, the handle device 118 may be attached to a side of the cockpit peripheral rim 125 that is opposite to the side on which the collapsible ladder 102 is attached.

It is readily apparent that the aforedescribed watercraft self-rescue reentry devices 100, 200, 200', 200", 300 offer numerous advantages. First, the watercraft self-rescue reentry devices 100, 200, 200', 200", 300 make reentry easy for people of all ages and experience levels, thus bringing safety to the users of small recreational watercrafts. Secondly, the watercraft self-rescue reentry devices 100, 200, 200', 200", 300 have the potential to reduce the capsized time of small recreational watercrafts so as to reduce the risk of drowning for the users thereof. Finally, the watercraft self-rescue reentry devices 100, 200, 200', 200", 300 have the potential to add completely new levels of safety to popular paddlesports, such as kayaking and canoeing. While the illustrative watercraft self-rescue reentry devices 100, 200, 200', 200", 300 are shown as being retrofitted on existing watercrafts, it is to be understood that the watercraft self-rescue reentry devices described herein could also be integrated into an original and streamlined watercraft design.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A watercraft self-rescue reentry device configured to facilitate a reentry of a user into a watercraft, said watercraft self-rescue reentry device comprising:

at least one pole member, said at least one pole member including at least one attachment device for attaching said at least one pole member to said watercraft;

a foot step coupled to said at least one pole member, said foot step configured to accommodate a foot of a user stepping thereon while said user is attempting to reenter said watercraft from water surrounding said watercraft; and a water anchor device coupled to said at least one pole member, said water anchor device configured to resist a moment applied to said at least one pole member by said user stepping on said foot step, said water anchor device configured to resist said moment applied to said at least one pole member by means of being at least partially immersed in said water, and said water anchor device configured to be stowed within a portion of an interior cavity of said at least one pole member when said watercraft self-rescue reentry device is not being used.

2. The watercraft self-rescue reentry device according to claim 1, wherein said at least one pole member comprises a first pole member and a second pole member, said first pole member configured to be attached to said watercraft by said at least one attachment device, and said second pole member configured to be telescopically received within said first pole member, said second pole member configured to be slidingly displaced relative to said first pole member between a stowed position where said second pole member is disposed inside said first pole member and an extended position where said second pole member extends outwardly from an end of said first pole member, said second pole member being coupled to one of said foot step and said water anchor device.

3. The watercraft self-rescue reentry device according to claim 1, wherein said at least one attachment device is configured to be attached to a top surface of a watercraft, said at least one attachment device including a pivotal mechanism so as to enable said at least one pole member to rotate relative to said watercraft.

4. The watercraft self-rescue reentry device according to claim 1, wherein said foot step is configured to be stowed within another portion of said interior cavity of said at least one pole member when said watercraft self-rescue reentry device is not being used.

5. The watercraft self-rescue reentry device according to claim 4, wherein said foot step is coupled to said at least one pole member by a plurality of arm members, said plurality of arm members configured to be telescopically received within said at least one pole member, said plurality of arm members configured to be slidingly displaced relative to said at least one pole member between a stowed position where said plurality of arm members are disposed inside said at least one pole member and an extended position where said plurality of arm members extend outwardly from an end of said at least one pole member.

6. The watercraft self-rescue reentry device according to claim 5, wherein said plurality of arm members comprises a first arm member and a second arm member, said second arm member being pivotably coupled to said first arm member by a hinge joint.

7. The watercraft self-rescue reentry device according to claim 6, wherein said foot step is pivotably attached to said second arm member so as to enable said foot step to be rotated between a collapsed position where said foot step is disposed inside said second arm member and an operative position where said foot step is configured to accommodate said foot of said user stepping thereon.

8. The watercraft self-rescue reentry device according to claim 1, further comprising a plurality of pull cords attached to said water anchor device, a first one of said plurality of pull cords configured to collapse said water anchor device prior to said water anchor device being stowed inside said portion of said interior cavity of said at least one pole member, and a second one of said plurality of pull cords configured to retract said water anchor device into said portion of said interior cavity of said at least one pole member for housing said water anchor device when said water anchor device is not being used.

9. The watercraft self-rescue reentry device according to claim 8, further comprising a pole cap attached to a distal end of said first one of said plurality of pull cords, said pole cap configured to be grasped and pulled by said user so as to facilitate a removal of said water anchor device from said portion of said interior cavity of said at least one pole member when said water anchor device is being deployed by said user.

10. The watercraft self-rescue reentry device according to claim 1, further comprising a weight coupled to said water anchor device, said weight configured to facilitate a sinking of said water anchor device in said water when said water anchor device is initially deployed by said user.

11. A watercraft self-rescue reentry device configured to facilitate a reentry of a user into a watercraft, said watercraft self-rescue reentry device comprising:

at least one pole member having an interior cavity, said at least one pole member including at least one attachment device for attaching said at least one pole member to said watercraft;

a foot step coupled to said at least one pole member, said foot step configured to accommodate a foot of a user stepping thereon while said user is attempting to reenter said watercraft from water surrounding said watercraft, said foot step configured to be stowed within a first portion of said interior cavity of said at least one pole member when said watercraft self-rescue reentry device is not being used; and a water anchor device coupled to said at least one pole member, said water anchor device configured to resist a moment applied to said at least one pole member by said user stepping on said foot step, said water anchor device configured to resist said moment applied to said at least one pole member by means of being at least partially immersed in said water, said water anchor device configured to be stowed within a second portion of said interior cavity of said at least one pole member when said watercraft self-rescue reentry device is not being used.

12. The watercraft self-rescue reentry device according to claim 11, wherein said at least one pole member comprises a first pole member, a second pole member, and a third pole member, said first pole member configured to be attached to said watercraft by said at least one attachment device, and said second and third pole members each configured to be telescopically received within said first pole member, said second and third pole members configured to be slidingly displaced relative to said first pole member between stowed positions where said second and third pole members are disposed inside said first pole member and extended positions where said second and third pole members extend outwardly from respective ends of said first pole member, said second pole member being coupled to said foot step and said third pole member being coupled to said water anchor device.

13. The watercraft self-rescue reentry device according to claim 12, wherein said foot step is connected to said second pole member by a first cord member, and said water anchor device is connected to said third pole member by a second cord member.

14. The watercraft self-rescue reentry device according to claim 11, wherein said at least one attachment device is configured to be attached to a peripheral rim of a watercraft cockpit, said at least one attachment device including a first attachment device configured to engage with a first side of said peripheral rim of said watercraft cockpit and a second attachment device configured to engage with a second side of said peripheral rim, said first side of said peripheral rim of said watercraft cockpit being disposed generally opposite to said second side of said peripheral rim of said watercraft cockpit.

15. The watercraft self-rescue reentry device according to claim 14, wherein said second attachment device is rotatable relative to said at least one pole member so as to enable said watercraft self-rescue reentry device to be selectively engaged with, and disengaged from, said peripheral rim of said watercraft cockpit.

16. The watercraft self-rescue reentry device according to claim 11, wherein said watercraft to which said at least one pole member is configured to be attached comprises a kayak or a canoe.

17. A watercraft self-rescue reentry device configured to facilitate a reentry of a user into a watercraft, said watercraft self-rescue reentry device comprising:

a collapsible ladder, said collapsible ladder including at least one attachment device at an upper end thereof for attaching said collapsible ladder to said watercraft, said collapsible ladder further including one or more steps for accommodating the feet of a user while said user is attempting to reenter said watercraft from water surrounding said watercraft; and an inflatable bladder attached to said collapsible ladder, said inflatable bladder configured to exert a buoyancy force on said collapsible ladder while said user is attempting to reenter said watercraft so as to facilitate a reentry of said user into said watercraft, said inflatable bladder being attached to a rear side of said collapsible ladder; and wherein said collapsible ladder and said inflatable bladder are configured to be rolled together for compact storage of said watercraft self-rescue reentry device.

18. The watercraft self-rescue reentry device according to claim 17, wherein said at least one attachment device comprises first and second attachment devices configured to be attached to a peripheral rim of a watercraft cockpit, said first attachment device attached to a first longitudinal support member of said collapsible ladder, and said second attachment device attached to a second longitudinal support member of said collapsible ladder, said first longitudinal support member of said collapsible ladder being spaced apart from said second longitudinal support member of said collapsible ladder.

* * * * *